US012173585B2

(12) United States Patent
Stewart et al.

(10) Patent No.: US 12,173,585 B2
(45) Date of Patent: Dec. 24, 2024

(54) APPARATUS, SYSTEM AND METHOD FOR TETHERING A SUBSEA ASSEMBLY

(71) Applicant: TLA SUBSEA LTD, Laurencekirk (GB)

(72) Inventors: James MacDonald Stewart, Laurencekirk Aberdeenshire (GB); Charles Alexander Gilmour Gourley, Whiterashers Aberdeenshire (GB)

(73) Assignee: TLA SUBSEA LTD, Laurencekirk (GB)

( * ) Notice: Subject to any disclaimer, the term of this patent is extended or adjusted under 35 U.S.C. 154(b) by 0 days.

(21) Appl. No.: 18/259,036

(22) PCT Filed: Dec. 22, 2021

(86) PCT No.: PCT/GB2021/053400
§ 371 (c)(1),
(2) Date: Jun. 22, 2023

(87) PCT Pub. No.: WO2022/136867
PCT Pub. Date: Jun. 30, 2022

(65) Prior Publication Data

US 2024/0218761 A1 Jul. 4, 2024

(30) Foreign Application Priority Data

Dec. 23, 2020 (GB) ..... 2020531

(51) Int. Cl.
*E21B 41/00* (2006.01)
*E21B 33/064* (2006.01)

(52) U.S. Cl.
CPC ..... *E21B 41/0007* (2013.01); *E21B 33/064* (2013.01)

(58) Field of Classification Search
CPC ..... E21B 41/0007; E21B 33/064
See application file for complete search history.

(56) References Cited

U.S. PATENT DOCUMENTS 3,023,808 A * 3/1962 St John ..... E21B 7/12 175/209
4,354,446 A 10/1982 Goldsmith et al.
(Continued)

FOREIGN PATENT DOCUMENTS

WO WO-2019/068130 A1 4/2019

OTHER PUBLICATIONS

International Search Report and Written Opinion on PCT App. PCT/GB2021/053400 dated Apr. 19, 2022 (12 pages).

*Primary Examiner* — Aaron L Lembo
(74) *Attorney, Agent, or Firm* — Foley & Lardner LLP

(57) ABSTRACT

The present invention relates to an apparatus, system and method for tethering a blowout preventer (BOP) of a subsea assembly under tension. The system comprising: a subsea mount arranged on a sea bed in spaced relationship to the BOP; a tethering member configured to tether the BOP to the subsea mount; a tensioning apparatus configured to apply a tension to the tethering member, wherein the tensioning apparatus comprises: a first tensioning mechanism configured to apply a first tension to the tethering member; and a second tensioning mechanism configured to subsequently apply a second tension to the tethering member, wherein the second tension is greater than the first tension.

25 Claims, 26 Drawing Sheets

(56) References Cited

U.S. PATENT DOCUMENTS

| | | | | |
|---|---|---|---|---|
| 4,818,146 | A | 4/1989 | Fontenot | |
| 9,359,852 | B2 * | 6/2016 | Kebadze | E21B 41/0007 |
| 9,879,396 | B2 * | 1/2018 | Kebadze | E21B 33/064 |
| 11,525,338 | B2 * | 12/2022 | Forster | F15B 19/00 |
| 11,549,325 | B2 * | 1/2023 | Maher | E21B 41/0007 |
| 2006/0162933 | A1 * | 7/2006 | Millheim | E21B 17/012 166/344 |
| 2014/0374116 | A1 * | 12/2014 | Kelso | E21B 33/035 166/345 |
| 2016/0251817 | A1 | 9/2016 | Kebadze et al. | |
| 2018/0003008 | A1 | 1/2018 | Osen | |
| 2020/0003025 | A1 * | 1/2020 | Maher | E21B 41/0007 |
| 2022/0402577 | A1 * | 12/2022 | Maher | B63B 21/27 |

* cited by examiner

Figure 18 (cross-section view along A-A)

Figure 19 (cross section along B-B)

APPARATUS, SYSTEM AND METHOD FOR TETHERING A SUBSEA ASSEMBLY

CROSS-REFERENCE TO RELATED APPLICATIONS

This application claims the benefit of priority to International Application No. PCT/GB2021/053400, filed Dec. 22, 2021, which claims the benefit of Great Britain Patent Application No. 202531.6, filed Dec. 23, 2020, each of which is hereby incorporated by reference in its entirety.

TECHNICAL FIELD

The present invention relates to an apparatus, system and method for tethering a subsea assembly, particularly a blowout preventer (BOP) of a subsea assembly.

INTRODUCTION

FIG. 1 depicts a conventional subsea assembly of an offshore well 10 in a construction, intervention, de-construction and/or abandonment mode. As shown, the well 10 comprises a floating offshore vessel 12 at the sea surface 14, a horizontal tree 16 releasably connected to a wellhead 18 disposed at an upper end of a primary conductor 20 extending into the wellbore 22, a subsea blowout preventer (BOP) 24 releasably connected to the tree 16, and a lower marine riser package (LMRP) 26 releasably connected to the BOP 24. The tree 16 may not necessarily be present, for example, during drilling operations. The BOP 24 is provided to prevent blowouts caused by an uncontrolled release of crude oil or natural gas from the well. The BOP may be part of the subsea assembly during one or more mode of operation, for example a construction, intervention, de-construction and/or abandonment mode. The tree 16, the BOP 24, and the LMRP 26 are at least substantially vertically arranged or stacked one-above-the-other, and are generally coaxially aligned with the wellhead 18. The subsea stack is connected to a floating vessel at the surface via a riser 28.

During the lifespan, the subsea assembly is subject to loads including cyclical loads due to riser movement (for example, from surface vessel motions, wave actions, vortex induced vibrations, or combinations thereof) and environmental loads such as subsea currents. Together, these loads can induce fatigue in one or more component of the subsea assembly, which over time may compromise the integrity of the subsea assembly. This may be of particular concern due to the configuration, weight, and vertical arrangement of the subsea assembly components, which present a relatively large surface area for interacting with the subsea current loads.

Additionally, the loads can induce bending moments and associated stresses in one or more components of the subsea assembly, which may, for example, be increased when the relatively tall and heavy combination of a horizontal tree and BOP are angled relative to vertical. The bending moments and associated stresses further induce fatigue in the subsea assembly.

The increasing size and weight of BOPs and longer drill times that are now commonly employed also increase the risk of subsea assembly fatigue. In particular, the risk of fatigue when using newer generation BOPs with legacy subsea assemblies which have a less robust design.

The present invention relates to a solution to mitigate the risk of subsea assembly fatigue described above.

SUMMARY OF INVENTION

Embodiments of the present invention relate to a tethering solution to improve the strength and fatigue performance of subsea structures, such as blowout preventers (BOPs).

A first aspect of the invention provides a tensioning apparatus for tensioning a tethering member arranged to tether a subsea blowout preventer (BOP).

The tensioning apparatus comprises:

- a first tensioning mechanism coupled to the tethering member and configured to apply a first tension to the tethering member; and
- a second tensioning mechanism configured to subsequently apply a second tension to the tethering member, wherein the second tension is greater than the first tension.

The first tensioning mechanism applies a first tension to the tethering member, for example, to remove slack in the tethering member. The first tension may be a predefined tension. The second tensioning mechanism then applies a second tension to set a final tethering tension to the tethering member. The second tension may be a predefined tension. Thus, tension is applied to a tethering member in a two stage-process. Advantageously, such tensioning apparatus substantially enhance the stability of a subsea assembly by restricting, preferably inhibiting movement and lateral bending of the BOP.

The tensioning apparatus may be configured to operate in a tension mode to apply tension to the tethering member in the two-stage process. The tensioning apparatus may be configured to operate in a first tension mode during a first tensioning stage, whereby the first tensioning mechanism is configured to initially apply the first tension to the tethering member. The tensioning apparatus may be configured to operate in a second tension mode during the second tensioning stage, whereby the second tensioning mechanism is configured to subsequently apply the second tension to the tethering member. Optionally, the tensioning apparatus may be configured to operate in a slack mode to reduce tension in the tethering member. The tensioning apparatus may be configured to operate in the slack mode to reduce tension applied to the tethering member during the tension mode. Advantageously, the tensioning apparatus may be configured to operate in the slack mode to allow for slack in the tethering member. The tension may be reduced by a predefined reduction in tension and/or the slack may be a pre-defined slack. The tensioning apparatus may be configured to operate in a first slack mode, whereby the first tensioning mechanism is configured to reduce the first tension applied to the tethering member. For example, in the first slack mode, the first tensioning mechanism may be configured to decrease or at least substantially reverse (remove) the first tension applied to the tethering member. The tensioning apparatus may be configured to operate in a second slack mode, whereby the second tensioning mechanism is configured to reduce the second tension. For example, in the second slack mode, the second tensioning mechanism may be configured to decrease or at least substantially reverse (remove) the second tension applied to the tethering member. The tensioning apparatus may be configured to operate in a slack mode to reduce tension in a two-stage process. For example, following the sequential application of the first tension and second tension to the tethering member, the tensioning apparatus may be configured to initially operate in a second slack mode to reduce the second tension applied to the tethering member, and subsequently operate in a first slack mode to reduce the first tension applied to the tethering member.

Optionally, the first tensioning mechanism may be a mechanically driven tensioning mechanism, and the second tensioning mechanism may be a mechanically driven tensioning mechanism. Advantageously, mechanically driven mechanisms do not require hydraulic pressure or hydraulic fluid. As such mechanically driven mechanisms are more environmentally friendly because they avoid the risk of hydraulic fluid being exposed to the environment. Additionally, mechanically driven mechanisms are typically less complex and more reliable than hydraulic mechanisms. Mechanical mechanisms are also cheaper to manufacture in comparison to hydraulic mechanisms. Mechanical mechanisms have a generally smoother driving action than hydraulic mechanisms, which are based on a repetitive hydraulic pumping cycle. The first tensioning mechanism and/or the second tensioning mechanism may, for example, comprise a gear set, which advantageously require relatively low input forces/torques and provide relatively high output forces/torques.

Optionally, the first tensioning mechanism may comprise a first actuator, and the first actuator may be operable by an associated first driving tool. The second tensioning mechanism may comprise a second actuator, and the second actuator may be operable by an associated second driving tool. The actuator may comprise an interface or interconnection configured to engage and be operably driven by the associated driving tool. The associated driving tool may be carried and controlled by a remotely operated vehicle (ROV). Additionally or alternatively, the actuator and/or associated driving tool may be manually operated. Advantageously, by using mechanism mechanisms, the actuators can input a low input force to achieve a higher output force. As such, the associated driving tool on the ROV may be driven by a mechanical mechanism, thereby further avoiding the need for a hydraulic mechanism.

The first and second mechanical actuators are advantageously less complex over alternative mechanisms, and allow for the tensioning apparatus to be deployed and operated in an easy and effective manner. In direct contrast, conventional hydraulically driven actuators require specialist tooling and the mobilisation of highly trained personnel, and this in turn results in higher operational costs, longer installation and removal times and, ultimately, more operational down time.

Optionally, the first tensioning mechanism may comprise a rotatable drum. The rotatable drum uses a rotary action to wind-in the tethering member onto the drum and/or wind-out the tethering member from the drum.

Optionally, when the first tensioning mechanism is operating in a first tension mode, the rotatable drum may be configured to rotate to wind-in (reel-in) the tethering member and thereby apply the first tension. For example, the rotatable drum winds-in the tethering member until the tethering member is under the first tension and the tethering member is suitably taut.

Optionally, when the first tensioning mechanism is operating in a first slack mode, the rotatable drum may be configured to rotate to wind-out (reel-out) the tethering member and thereby reduce the first tension in the tethering member. For example, the rotatable drum may wind-out the tethering member to reduce the first tension in the tethering member and allow slack in the tethering member.

Advantageously, the rotatable drum can accommodate tethering members of variable lengths, which can be wound-in or wound-out from the rotatable drum as required. The rotatable drum can rotate to wind-in a tethering member of any length until it is under the first tension and the tethering member is suitably taut. The rotatable drum can rotate to wind-out a tethering member of any length until the tension is decreased or removed and the tethering member is suitably slack. The rotary action of the rotatable drum allows for a continuous (non-discrete and non-limiting) winding-in and/or winding-out of the tethering member, and for high resolution adjustment of the tension of the tethering member. By using the rotary action of the rotatable drum, the tensioning apparatus is not limited to tensioning a tethering member of only a specific pre-cut length. The rotatable drum allows for the tensioning apparatus to be locatable at variable distances from the subsea BOP. The rotatable drum allows for the tensioning apparatus to be suitable for use, and re-use, at different subsea BOP sites. In direct contrast, a conventional first tensioning mechanism employing a linear locking action has a finite tensioning effect that is limited by the number of linear locking elements. The tensioning effect is discrete due to linear movement between each locking element. The length of the tethering member is limited according to the number of linear locking elements and so a pre-cut tethering member based on the distance between the subsea BOP and tensioning apparatus is required. The location of the tensioning apparatus relative to the subsea BOP is thereby limited.

Optionally, the tethering member may be pre-mounted on the tensioning apparatus prior to arranging subsea. As such, one end of the tethering member is fixedly engaged to the tensioning apparatus and so, advantageously, the attachment of the tethering member to the tensioning apparatus does not need be performed in a subsea environment. Additionally, by being pre-mounted on the tensioning apparatus, the tethering member is controlled in the subsea environment during the subsea arranging of the tensioning apparatus. In direct contrast, a conventional loose/un-mounted tethering member may become tangled and/or caught on subsea objects, including the BOP stack, ROV and/or natural/environmental snag points, and thereby pose a safety and/or operational concern. In the example where a first tensioning mechanism comprises the rotatable drum, the tethering member may be pre-wound on the rotatable drum to pre-mount the tethering member.

Optionally, the tensioning apparatus may have a deployment mode to deploy the pre-mounted tethering member from the tensioning apparatus for tethering. For a tethering member pre-wound on the rotatable drum of the first tensioning mechanism, the tensioning apparatus may be configured to operate in a deployment mode, whereby the rotatable drum is configured to wind-out the pre-wound tethering member so as to deploy the tethering member for tethering. In the deployment mode, the tensioning apparatus may be configured to allow the rotatable drum to free wheel as it winds-out the tethering member for tethering. Advantageously, the mechanically driven rotatable drum can free wheel without requiring a clutch.

Optionally, the first tensioning mechanism may comprise a first lock to lock the first tensioning mechanism to at least substantially retain the first tension applied to the tethering member. For example, for a first tensioning mechanism comprising a rotatable drum, the first lock may comprise a drum lock configured to prevent back rotation of the drum. Optionally, the drum lock may be a spring-loaded lock. A spring-loaded lock may be advantageous due to the quick release and locking action.

Optionally, the tensioning apparatus may comprise a frame. The first tensioning mechanism and/or second tensioning mechanism may be arranged vertically or horizontally, or any suitable orientation on the frame.

Optionally, the second tensioning mechanism may be operatively associated with the first tensioning mechanism. For example, the second tensioning mechanism may be configured to move the first tensioning mechanism. In an example, the first tensioning mechanism may be moveably arranged on the frame to allow for displacement of the first tensioning mechanism relative to the frame by the second tensioning mechanism.

Optionally, when operating in the second tension mode, the second tensioning mechanism may be configured to move the first tensioning mechanism and thereby apply the second tension to the tethering member. The second tensioning mechanism may be configured to move the first tensioning mechanism in a retracting direction to apply the second tension. For example, the second tensioning mechanism may be configured to move the first tensioning mechanism in a retracting direction between a first position and a second position, and any position therebetween, to apply the second tension to the tethering member. When the first tensioning mechanism is arranged in the first position, the second tension applied to the tethering member may be a minimum (e.g. approximately zero) second tension. When the first tensioning mechanism is arranged in the second position, the second tension applied to the tethering member may be a maximum second tension. As such, the second tension in the tethering member increases as the second tensioning mechanism moves the first tensioning mechanism in the retracting direction between the first position and the second position, and any position therebetween. In the example when the first tensioning mechanism is movably arranged on the frame, when the second tensioning mechanism is operating in the second tension mode, the second tensioning mechanism may be configured to displace the first tensioning mechanism in a retracting direction relative to the frame to apply the second tension to the tethering member. The second tension may be applied by linear displacement of the first tensioning mechanism relative to the frame. In operation, the second tensioning mechanism moves the first tensioning mechanism in the linear retracting direction to increase tension in the tethering member until the second tension is applied and the desired final tension is achieved.

Optionally, when operating in the second slack mode, the second tensioning mechanism may be configured to move the first tensioning mechanism and thereby reduce the second tension in the tethering member. For example, the second tensioning mechanism may be configured to move the first tensioning mechanism to decrease or at least substantially reverse (remove) the second tension applied to the tethering member during the second tensioning mode. The second tensioning mechanism may be configured to move the first tensioning mechanism in a returning direction to reduce the second tension in the tethering member. The returning direction is in an opposite direction to the retracting direction. The second tensioning mechanism may be configured to move the first tensioning mechanism in a returning direction between the second position and the first position, and any position therebetween, to reduce the tension in the tethering member. When the second tension applied to the tethering member is an approximately zero second tension at the first position, the second tensioning mechanism may be configured to at least substantially reverse (remove) the second tension in the tethering member by moving the first tensioning mechanism in a returning direction to the first position. In the example when the first tensioning mechanism is movably arranged on the frame, when the second tensioning mechanism is operating in a second slack mode, the second tensioning mechanism may be configured to displace the first tensioning mechanism in a returning direction relative to the frame to reduce the second tension in the tethering member. The second tension may be reduced by linear displacement in the returning direction relative to the frame.

Optionally, the second tensioning mechanism may comprise a screw jack having a linear drive, wherein the first tensioning mechanism is mounted on the linear drive. The linear drive may comprise a rotatable screw operably coupled to a load nut. As the rotatable screw rotates, the linear drive may be configured to slide the first tensioning mechanism in a retracting direction relative to the frame, and thereby apply the second tension to the tethering member. Advantageously, a screw jack utilises the property of a screw thread on the rotatable screw to provide a mechanical advantage i.e. to amplify input force/torque. This is particularly advantageous as it allows a screw jack to apply heavy loads with little input torque, which is useful in subsea conditions when the application of torque may be limited.

Optionally, the second tensioning mechanism may comprise a second lock to lock the second tethering member to at least substantially maintain the second tension applied to the tethering member. That is, the second lock may substantially maintain the position of the first tensioning mechanism relative to the frame. The second locking mechanism may comprise a self-locking mechanism. In this context, self-locking should be understood to mean that locking occurs without the presence of power or a mechanical brake. This is particularly advantageous as it may substantially maintain the second tension in the tethering member when the input to actuate the second actuator is removed. For example, for a second tethering member comprising a screw jack, the screw jack is self-locking, which means that when the screw jack is not being operated, it will remain motionless and will not rotate backwards, regardless of how much load it is supporting. Advantageously, this makes screw jacks inherently safer than hydraulic mechanisms, for example, which may move backwards under load if the pressure on the hydraulic actuator is released.

Optionally, the tensioning apparatus may comprise one or more fail-safe lock to at least substantially maintain the tension applied to the tethering member.

Optionally, the tensioning apparatus may further comprise a tension monitoring system configured to monitor tension in the tethering member. The tensioning monitoring system may, for example, communicate the measured tension in the tethering member to an operator and/or other personnel at the surface (or other remote location) to enable tension monitoring, quantification of the external loads on the BOP, and rapid identification in the event of a potential tethering member failure.

Optionally, the tensioning apparatus may further comprise a clutch mechanism configured to automatically release at least some of the tension in the tethering member under excessive loading. In this way, the clutch mechanism may minimise the potential risk of damage to the tensioning apparatus, BOP and/or other subsea assembly components under excessive loading.

A second aspect of the invention provides a tensioning system for tethering a subsea blowout preventer (BOP) under tension. The system comprises:

a subsea mount arranged on a sea bed in spaced relationship to the BOP;

a tethering member configured to tether the BOP to the subsea mount;

a tensioning apparatus configured to apply a tension to the tethering member, wherein the tensioning apparatus comprises:

a first tensioning mechanism configured to apply a first tension to the tethering member; and a second tensioning mechanism configured to subsequently apply a second tension to the tethering member, wherein the second tension is greater than the first tension.

The tensioning apparatus may be a tensioning apparatus according to a first aspect of the invention.

The tensioning apparatus may be secured to the mount or the BOP. The tensioning apparatus may be rotatably secured to the mount or the BOP. Advantageously, rotation of the tensioning apparatus improves the tethering configuration and arrangement of the tensioning apparatus. The tensioning apparatus may be removably secured to the mount or the BOP to allow for the reuse, retrofitting, removal and/or reinstallation of the tensioning apparatus.

A third aspect of the invention provides a subsea method of tensioning a tethering member, wherein the tethering member is tethering a subsea blowout preventer (BOP) to a subsea mount, the method comprising:

providing a tensioning apparatus and coupling the tethering member to the tensioning apparatus, wherein the tensioning apparatus comprises a first tensioning mechanism and a second tensioning mechanism;

actuating the first tensioning mechanism to apply a first tension to the tethering member; and after applying the first tension, actuating the second tensioning mechanism to apply a second tension to the tethering member, wherein the second tension is greater than the first tension.

Optionally, the tensioning apparatus is a tensioning apparatus according to the first aspect of the invention.

Optionally, the first tensioning mechanism may comprise a rotatable drum and actuating the first tensioning mechanism may comprise rotating the drum to reel-in the tethering member and thereby apply the first tension to the tethering member.

Optionally, the first tensioning mechanism may be movably arranged on a frame and the second tensioning mechanism may comprise a linear drive. Actuating the second tensioning mechanism may comprise driving the linear driver to linearly displace the first tensioning mechanism in a retracting direction on the frame and thereby apply the second tension to the tethering member.

Optionally, the method may comprise:

actuating the second tensioning mechanism to reduce the applied second tension in the tethering member.

Optionally, actuating the second tensioning mechanism to reduce applied second tension may comprise driving the linear driver to linearly displace the first tensioning mechanism in a returning direction on the frame and thereby reduce the second tension in the tethering member.

Optionally, the method may comprise:

actuating the first tensioning mechanism to reduce the applied first tension in the tethering member.

Optionally, actuating the first tensioning mechanism to reduce the applied first tension may comprise rotating the drum to reel-out the tethering member and thereby reduce the first tension in the tethering member.

Optionally, wherein the tethering member is pre-mounted on the tensioning apparatus, the method may comprise:

actuating the tensioning apparatus to deploy the pre-mounted tethering member from the tensioning apparatus for tethering.

Optionally, wherein the pre-mounted tethering member may be pre-wound on the drum, and actuating the tensioning apparatus to deploy the pre-mounted tethering member for tethering may comprise freely rotating the drum to reel-out the tethering member.

It will be appreciated that any feature described herein as being suitable for incorporation into one or more aspects or embodiments of the present invention is intended to be generalisable across any aspect or embodiment of the present disclosure.

BRIEF DESCRIPTION OF DRAWINGS

The accompanying drawings illustrate presently exemplary embodiments of the disclosure, and together with the general description given above and the detailed description of the embodiments given below, serve to explain, by way of example, the principles of the disclosure.

DETAILED DESCRIPTION

Figure 1:
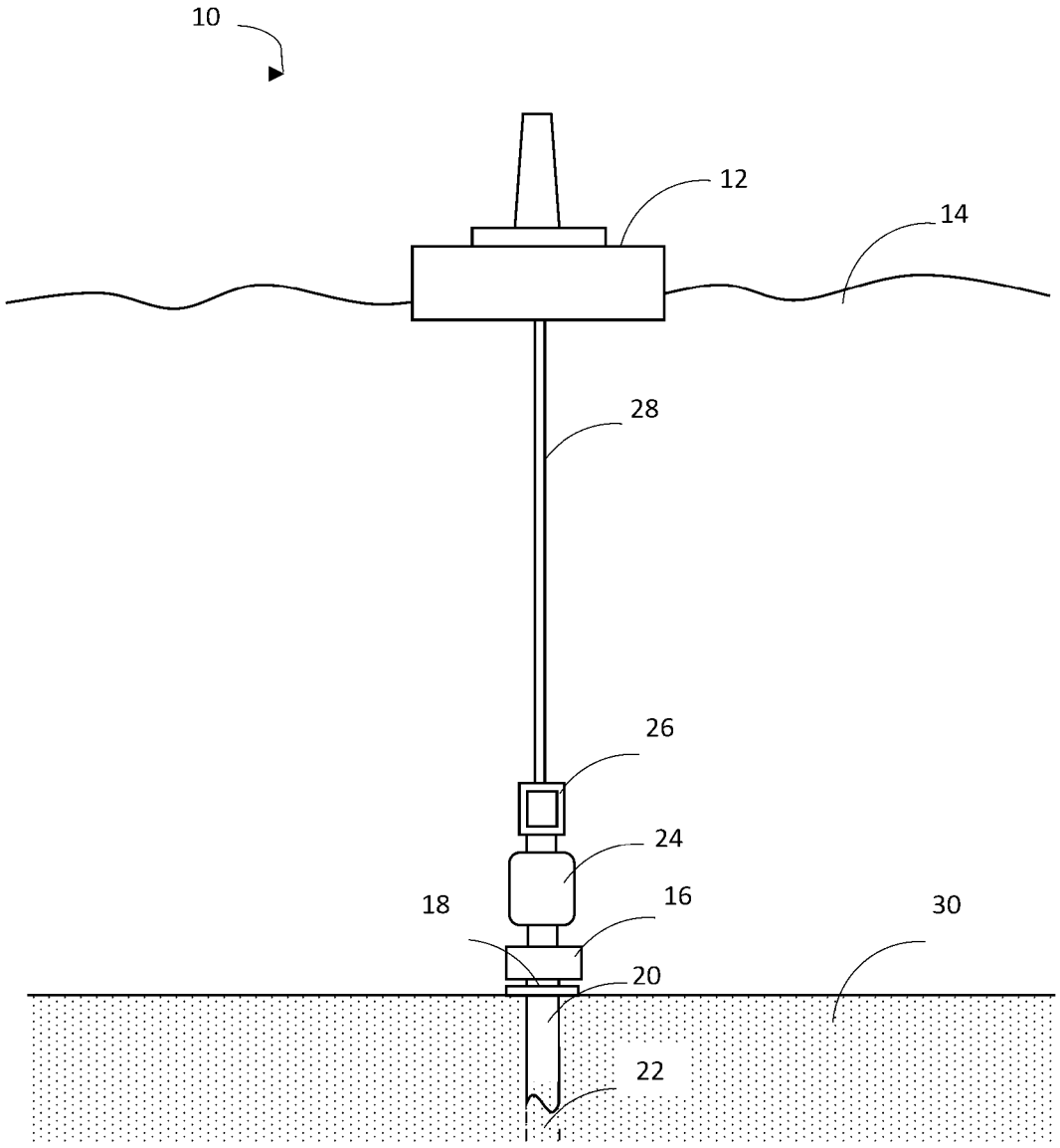
FIG. 1 shows a schematic view of a conventional example of a subsea assembly offshore well.
Figure 2:
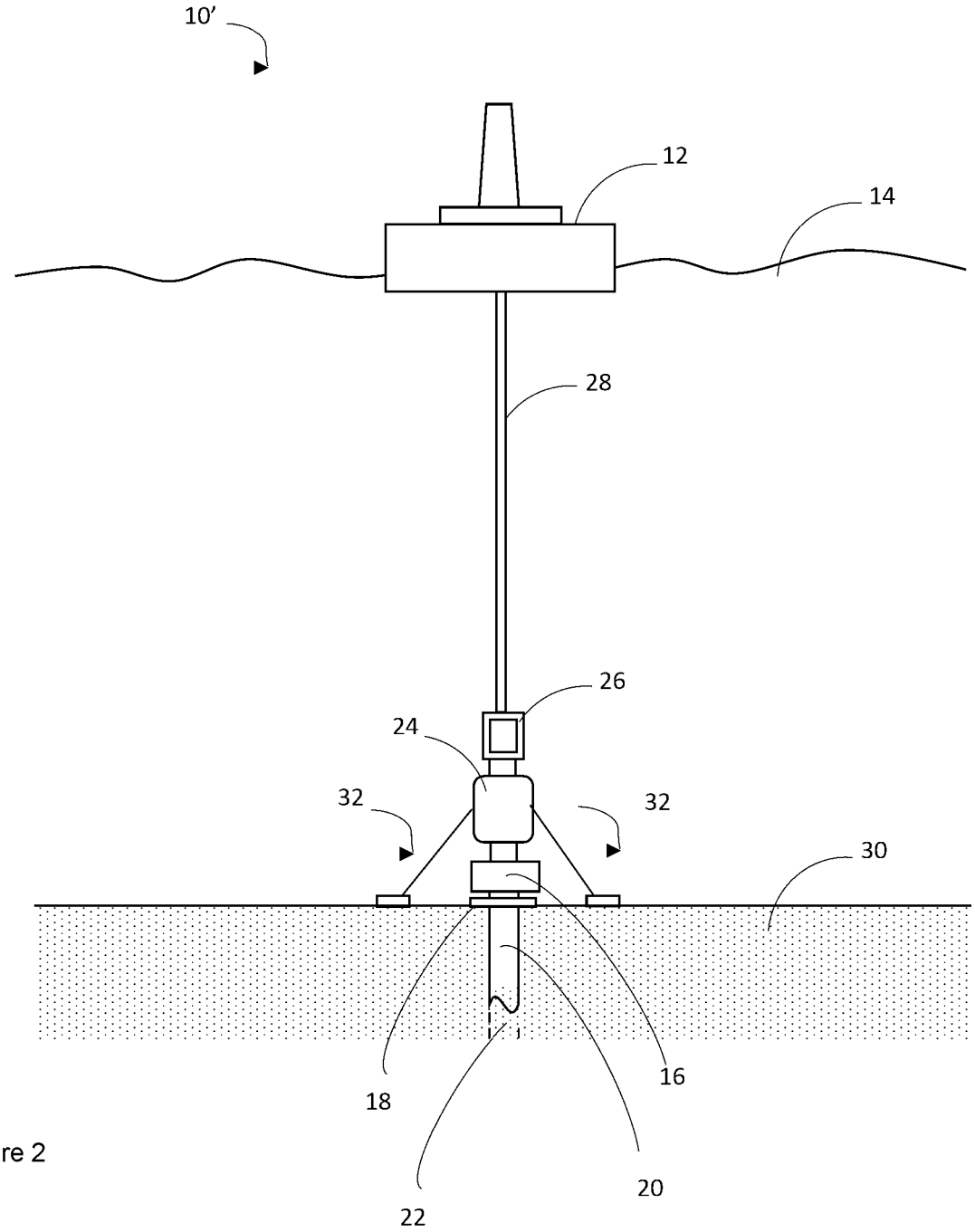
FIG. 2 shows a schematic view of a subsea assembly offshore well according to the present invention.

FIG. 2 depicts an example of an offshore well system 10' according to the present invention. In the example depicted, the well system is arranged for construction, intervention, de-construction and/or abandonment mode. The system 10' includes a floating offshore vessel 12 at the sea surface 14, a horizontal tree 16 releasably connected to a wellhead 18 disposed at an upper end of a primary conductor 20 extending into the wellbore 22, a subsea blowout preventer (BOP) 24 releasably connected to the tree 16, and a lower marine riser package (LMRP) 26 releasably connected to BOP 24. The tree 16, BOP 24, and LMRP 26 are vertically arranged or stacked one-above-the-other, and are generally coaxially aligned with wellhead 18. The tree 16 may not necessarily be present, for example, during drilling operations.

The wellhead 18 has a central axis and extends vertically upward from wellbore 22 above the seabed 30.

During its lifespan, the offshore well system comprises multiple modes of operation including, for example, construction, production, intervention, de-construction and/or abandonment mode. The BOP 24 may be part of the offshore well system during one or more mode. To minimise load fatigue, the system further comprises one or more tethering system 32 for tethering the BOP under tension.

The tethering system 32 comprises a subsea mount 34 arranged on a sea bed 30 in spaced relationship to the BOP, a tethering member 36 to tether the BOP 24 to the subsea mount, and a tensioning apparatus 38 to tension the tethering member.

The tensioning apparatus is configured to operate in a tension mode to apply tension to the tethering member. The tensioning apparatus comprises a first tensioning mechanism to apply a first tension to the tethering member, and a second tensioning mechanism to subsequently apply a second tension to the tethering member, wherein the second tension is greater than the first tension. As such, the invention provides a two-step tension process.

In the first step tension process, the first tensioning mechanism may be configured to operate in a first tension mode during which the first tension is applied to the tethering member. The first tension may be a predetermined first tension. The first tension may be sufficient to at least reduce slack of the tethering member. The first tension may fall within the range of approximately 1000 N to 4000 N, depending on the subsea assembly.

In the second step tension process, the second tensioning mechanism is configured to operate in a second tension mode during which the final or second tension is applied to the tethering member. The second tension may be a predetermined second tension. The second tension may be sufficient to at least restrict movement of the tethering member due to external loads acting on the BOP. The second tension may fall in the range of approximately 100,000 N to 500,000 N, or fall in the range of approximately 10,000 N to 200,000 N depending on the subsea assembly and external loads acting on the subsea assembly and tethering member.

The combined final tension (combined first and second tensions) may be sufficient to at least restrict, preferably prevent, undesired movement of the tethering member when subjected to external loads during one or more mode of operation of the well system. As such, undesired movement and lateral bending of the BOP 24 due to the external loads is impeded, and the overall fatigue performance of the well system is improved.

The tensioning apparatus may be configured to operate in a slack mode to reduce tension in the tethering member. The reducing of tension allows for the adjustment of tension applied to the tethering member during the tension mode, for example, depending on the external loads and/or mode of operation of the well system. The reducing of tension allows for the removal of tension applied to the tethering member, for example, when the tensioning apparatus is not in use or being de-constructed.

The first tensioning mechanism may be configured to operate in a first slack mode during which the first tension of the tethering member is reduced. The first tension may be reduced to decrease or remove the first tension applied to the tethering member during the first tension mode. The first tension may be reduced to at least allow slack of the tethering member.

The second tensioning mechanism may be configured to operate in a second slack mode during which the second tension of the tethering member is reduced. The second tension may be reduced to decrease or remove the second tension applied to the tethering member during the second tension mode.

Figure 3:
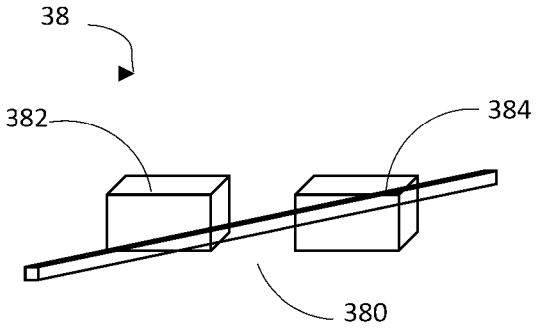
FIG. 3 shows a schematic view of a first example of tensioning apparatus according to the present invention.

FIG. 3 depicts a schematic arrangement of an example of a tensioning apparatus 38 according the present invention which may be used to apply tension to a tethering member tethering a BOP 24 to a subsea mount. In the example shown, the tensioning apparatus 38 comprises a frame 380, a first tensioning mechanism 382 and a second tensioning mechanism 384.

In use, a tethering member 36 arranged to tether the BOP 24 to the mount 34 is coupled to the tensioning apparatus 38. The first tensioning mechanism 382 is configured to apply a first tension to a tethering member. The second tensioning mechanism 384 is configured to subsequently apply a second tension to the tethering member, wherein the second tension is greater than the first tension.

FIGS. 4A-21 depict examples of tensioning apparatus 38 whereby the first tensioning mechanism comprises a rotatable drum 40 to which the tethering member (not shown) may be attached. The drum 40 uses a rotatory action to wind-in and wind-out the tethering member 36 around the drum. The winding of the tethering member 36 around the drum corresponds to the tension of the tethering member 36.

During the first tension mode, the drum winds-in (reels-in) the tethering member 36 and the first tension is applied to the tethering member 36. During the first slack mode, the drum winds-out (reels-out) the tethering member 36 and the first tension is reduced in the tethering member 36.

The first tensioning mechanism 382 may further comprise a first actuator to actuate the operation of the first tensioning mechanism 382 to apply the first tension (first tension mode). The first actuator may also actuate the operation of the first tensioning mechanism 382 to reduce the first tension (first slack mode). The first actuator is operable to be driven by an associated first driving tool.

The first driving tool may be carried and controlled by a Remotely Operated Vehicle (ROV). The ROV may be employed during the installation, maintenance, deconstruction and abandonment modes of the subsea assembly. The ROV may include multiple arms for manipulating objects, and a subsea camera for viewing the subsea operations. Streaming video and/or images from the cameras may be communicated to the surface or other remote location for viewing on a live or periodic basis.

In the examples of the tensioning apparatus 38 shown in FIGS. 4A-21, the first actuator comprises a first driving rod comprising an interconnection 42 to engage with the associated first driving tool. The first driving rod is operably coupled to the drum 40 via a gear set 44. The first actuator further comprises an ROV bucket 46 to guide the associated driving tool into engagement with the first driving rod interconnection 42. In the examples shown in FIGS. 4A-21, the first driving rod interconnection 42 protrudes within a centre portion of the ROV bucket 46. Rotation of the first driving rod by the first driving tool causes the drum to rotate and wind-in the tethering member 36 and thereby apply the first tension to the tethering member 36. When desired, the first driving tool may also be configured to drive the drum to rotate in an opposite direction to wind-out the tethering member 36 from the drum 40 and thereby reduce the tension in the tethering member 36.

The first tensioning mechanism may also comprise a first lock to lock the first tensioning mechanism so as to at least substantially retain the first tension applied to the tethering member. The first lock may at least substantially impede the release of the first tensioning mechanism. In the examples shown in FIGS. 4A-21, where the first tensioning mechanism is a rotatable drum 40, the first lock may be a drum lock configured to substantially prevent back rotation of the drum. In the example, the drum lock is a spring-loaded drum lock 48 which comprises a spring-loaded pin 50 that interlocks between a series of projections 52 arranged on an outer face 54 of a drum flange 56. The projections 52 are shaped such that the spring-loaded drum pin 50 is able to pass over the projections 52 as the drum rotates in one direction, while substantially preventing motion in the opposite direction. Other suitable locks and locking arrangements will be apparent to a person skilled in the art.

Figure 4A:
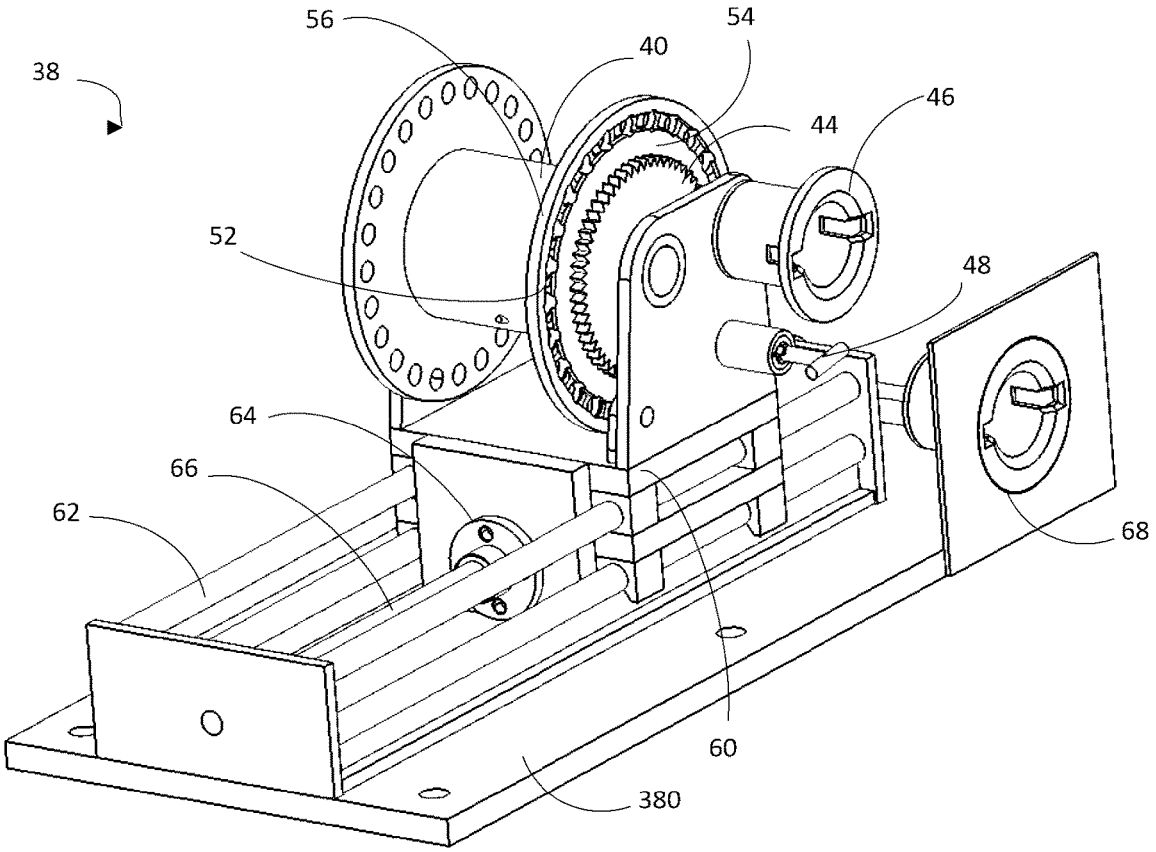
FIG. 4A shows a perspective view of a second example of a tensioning apparatus according to the present invention with the first tensioning mechanism in a retracted position.
Figure 4B:
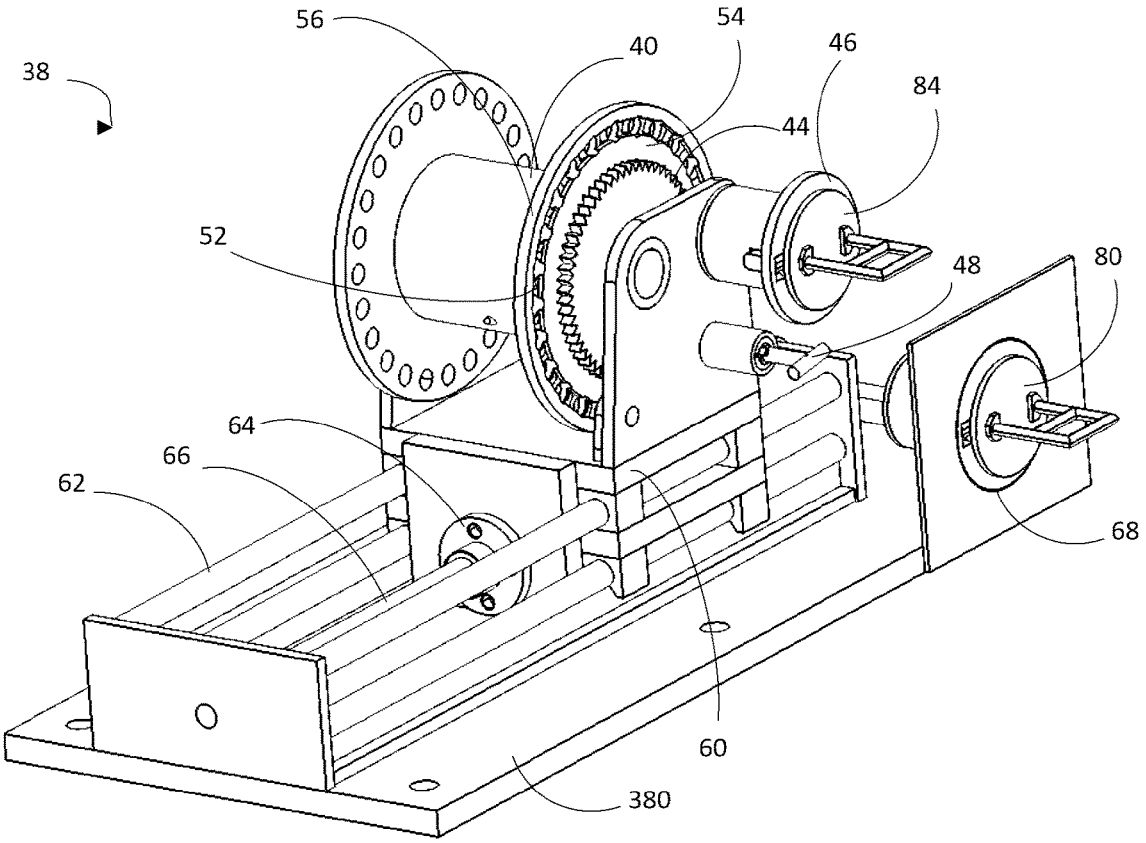
FIG. 4B shows a perspective view of the tensioning apparatus of FIG. 4A, showing the first tensioning mechanism includes a clutch mechanism and the second tensioning mechanism includes an fail-safe lock.
Figure 4C:
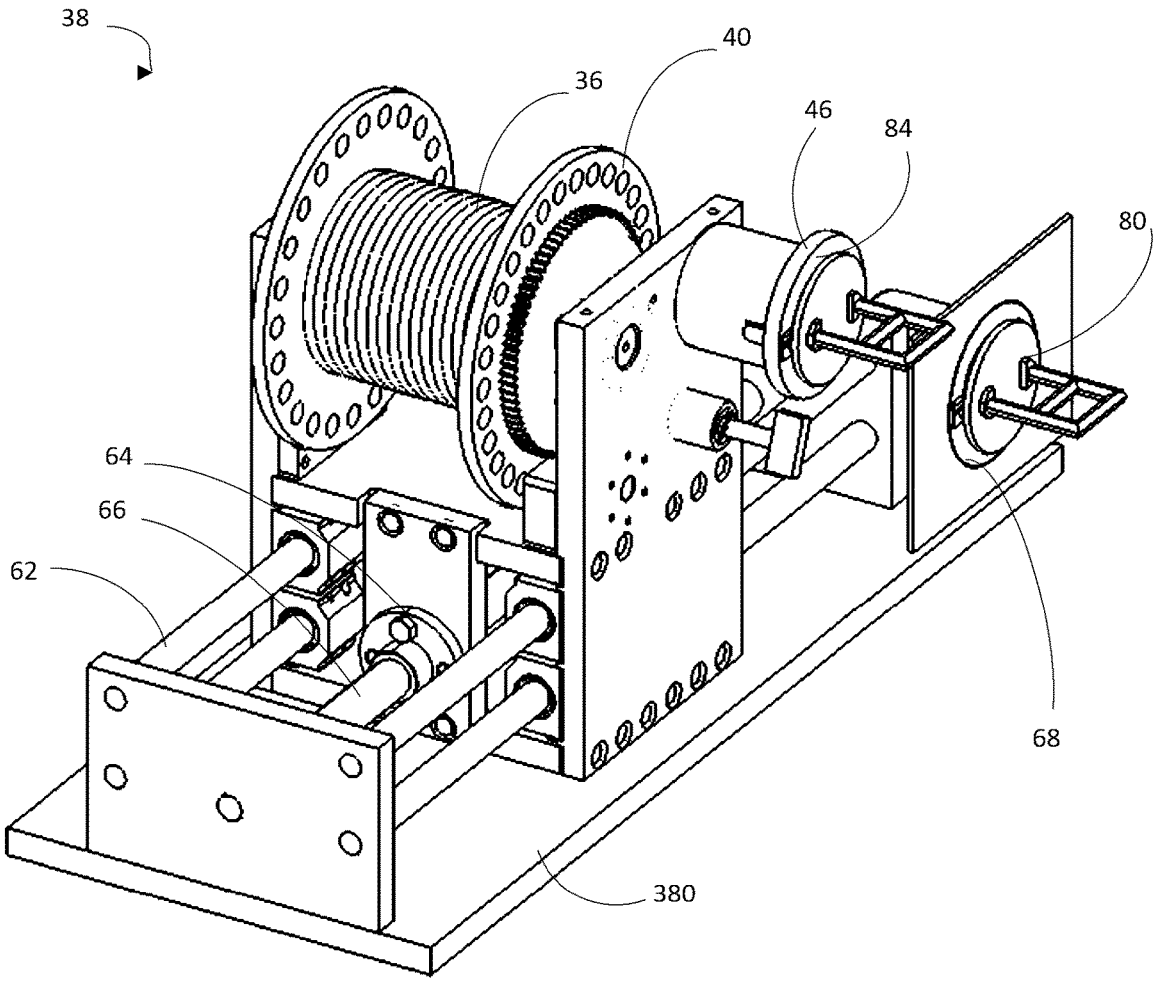
FIG. 4C shows a perspective view of the tensioning apparatus according to the present invention with the tethering member pre-wound on the first tensioning mechanism.
Figure 5:
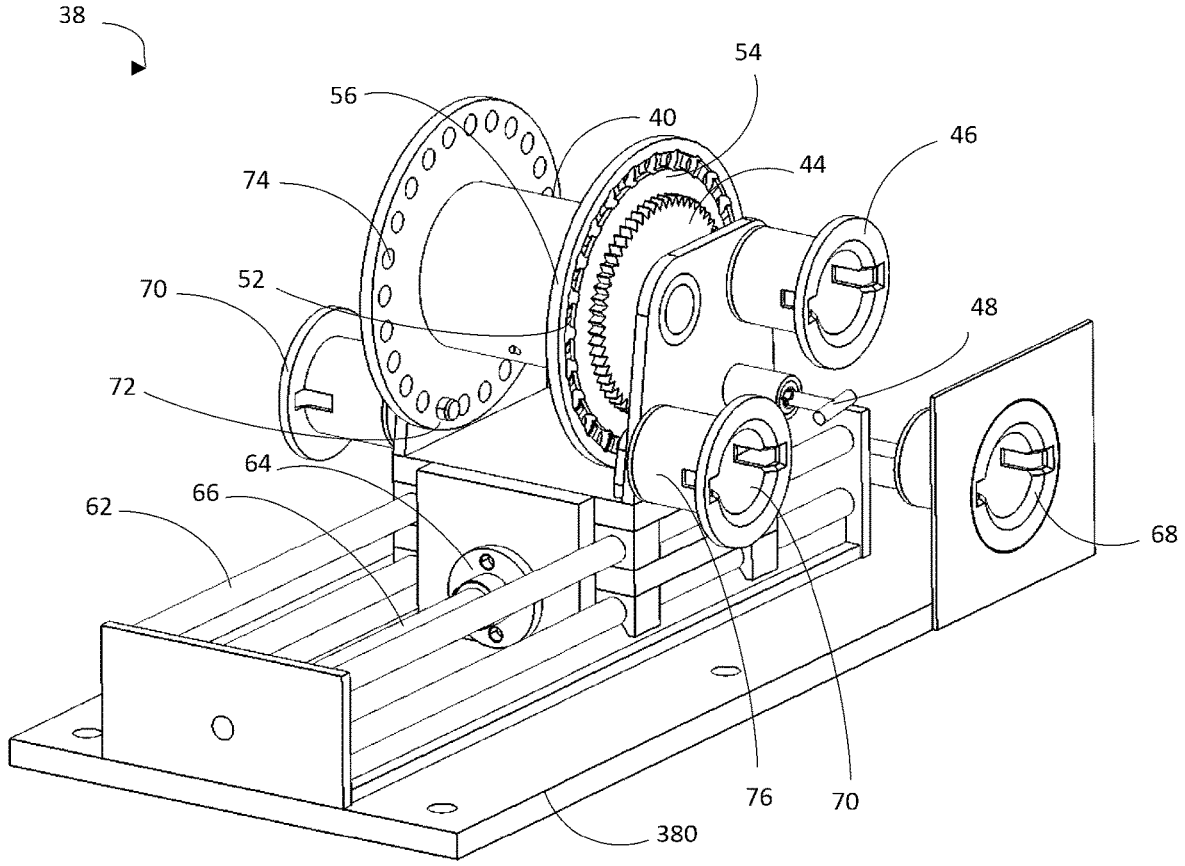
FIG. 5 shows a perspective view of a third example of a tensioning apparatus showing the first tensioning mechanism includes a fail-safe lock according to the present invention.
Figure 6:
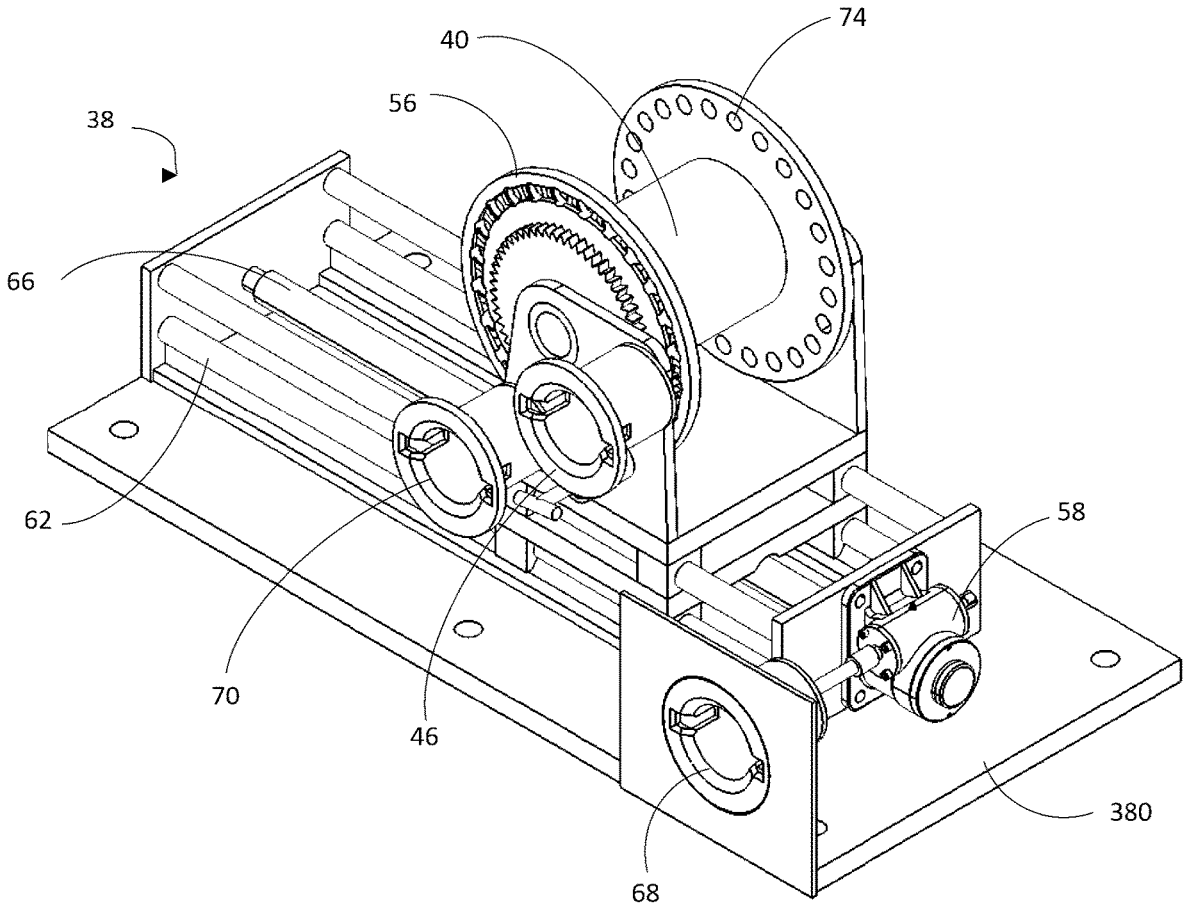
FIG. 6 shows an alternative perspective view of the tensioning apparatus of FIG. 5.
Figure 7:
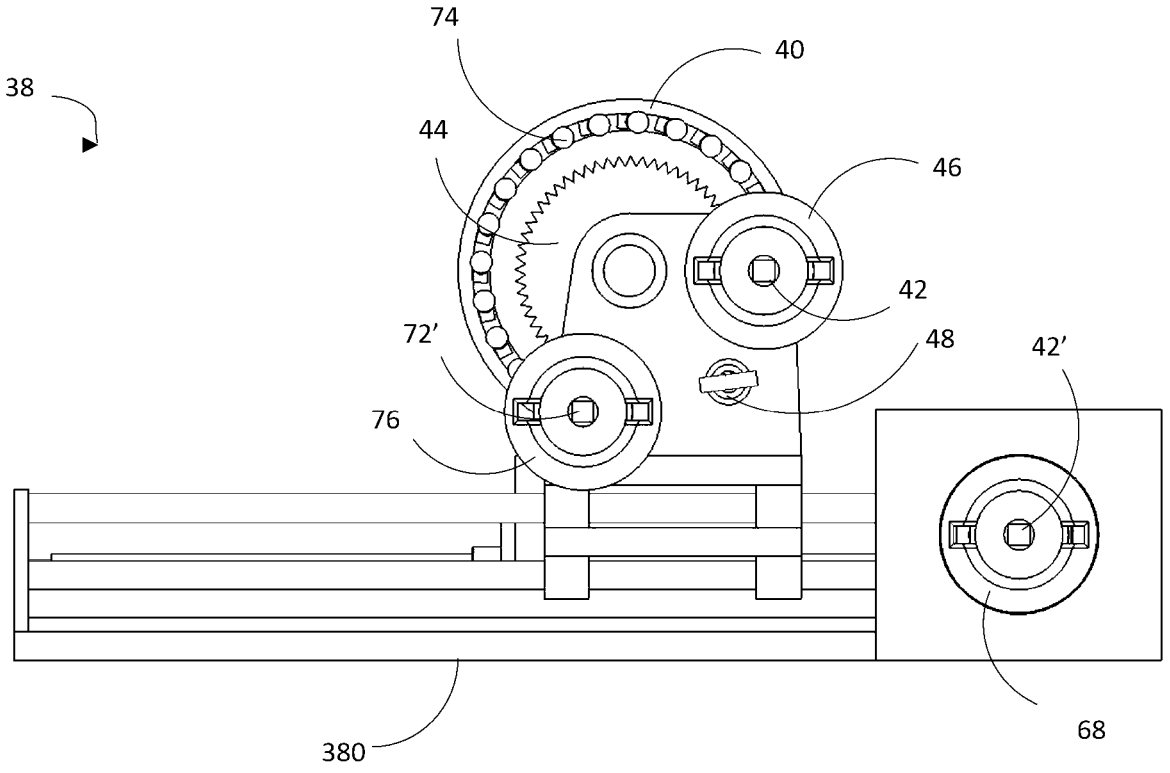
FIG. 7 shows a side on view of the tensioning apparatus of FIG. 5.

The tethering member 36 may be pre-mounted on the tensioning apparatus 38. As such, one end of the tethering member 36 is fixedly engaged to the tensioning apparatus 38 prior to locating subsea and so attachment to the tensioning apparatus 38 does not need to be performed in a subsea environment. In the examples shown in 4A-21, where the first tensioning mechanism 382 is a rotatable drum 40, the tethering member 36 may be pre-wound on the rotatable drum 40, as shown in FIG. 4C.

The tensioning apparatus may have a deployment mode to deploy the pre-mounted tethering member from the tensioning apparatus for tethering to the BOP. For example, in the example where the tethering member is pre-wound on the rotatable drum 40 of a first tensioning mechanism and when the tensioning apparatus is operating in deployment mode, the rotatable drum may be configured to wind-out the tethering member for tethering to the BOP and/or mount as required. The rotatable drum may be configured to free wheel as it winds-out the tethering member for tethering. For example, in the deployment mode, the spring-loaded drum lock 48 may be configured in a retracted position such that the spring-loaded drum pin 50 is spaced from and does not engage with the projections 52, thereby allowing the drum 40 to freely rotate relative to the drum lock 48 and the drum flange 56.

The second tensioning mechanism may be operatively associated with the first tensioning mechanism such that the second tensioning mechanism is configured to move the first tensioning mechanism. More specifically, the second tensioning mechanism may be configured to operate in a second tension mode to move the first tensioning mechanism such that the second tension is applied to the tethering member. The second tension mechanism may be configured to operate in a second slack mode to move the first tensioning mechanism such that the second tension is reduced in the tethering member.

For example, in the examples of the tensioning apparatus depicted in FIGS. 4A-21, the second tensioning mechanism comprises a screw jack 58 having a linear drive. In the examples depicted, the linear drive comprises four parallel shafts 62, a load nut 64, and a rotatable screw 66. As understood in the art, a screw jack 58 (also known as a jack screw, a worm screw jack, a machine screw jack or a lead screw jack) is a devise used to convert rotational motion into linear motion. In particular, a screw jack 58 utilises the configuration of a screw thread to provide mechanical advantage i.e. to amplify input force/torque. As such, the screw jack may apply heavy loads with low input torque. In an example, he screw jack may have a screw with a screw helix angle in the range of approximately 1 to 15 degree where the screw thread helix angle is a function of the screw diameter and the pitch of the thread. This may, for example, result in a screw pitch range of approximately 5 to 20 mm and a corresponding screw diameter range of approximately 30 to 200 mm. The screw jack may further include a worm gear to increase mechanical advantage. In an example, the screw jack 58 may have an input torque of approximately 170 Nm to achieve a second tension of falling in the range of approximately 10,000 N to 500,000 N. Hence, the tensioning apparatus of the present invention may be described as a low input torque, high output torque mechanism. This may be particularly advantageous in view of the practicalities of applying high levels of torque in subsea conditions.

The screw jack may have a screw thread whereby the screw thread helix angle provides a self-locking effect. As a result, the screw jack may maintain the second tension in the absence of an input torque.

Figure 8:
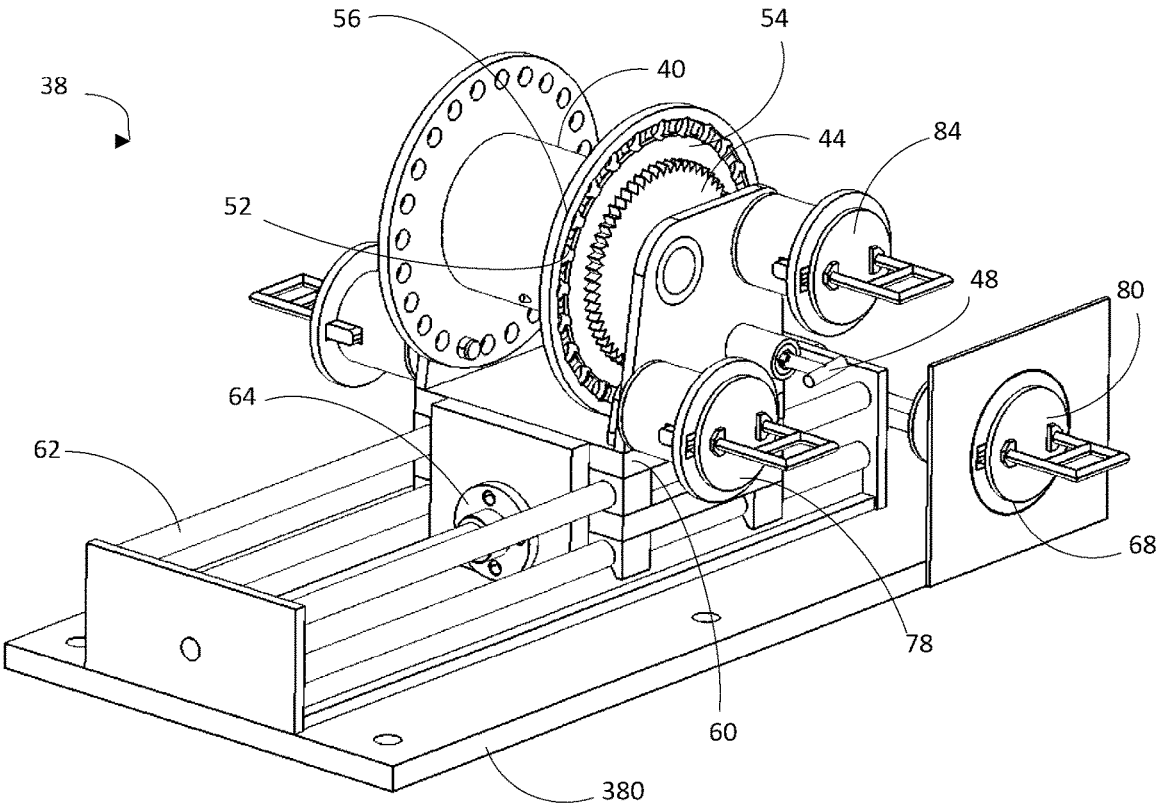
FIG. 8 shows a perspective view of the tensioning apparatus of FIG. 5, showing the first tensioning mechanism arranged in a retracted configuration, and including a clutch mechanism, the first tensioning mechanism including a fail-safe lock and the secondary tensioning mechanism including a fail-safe lock.
Figure 9:
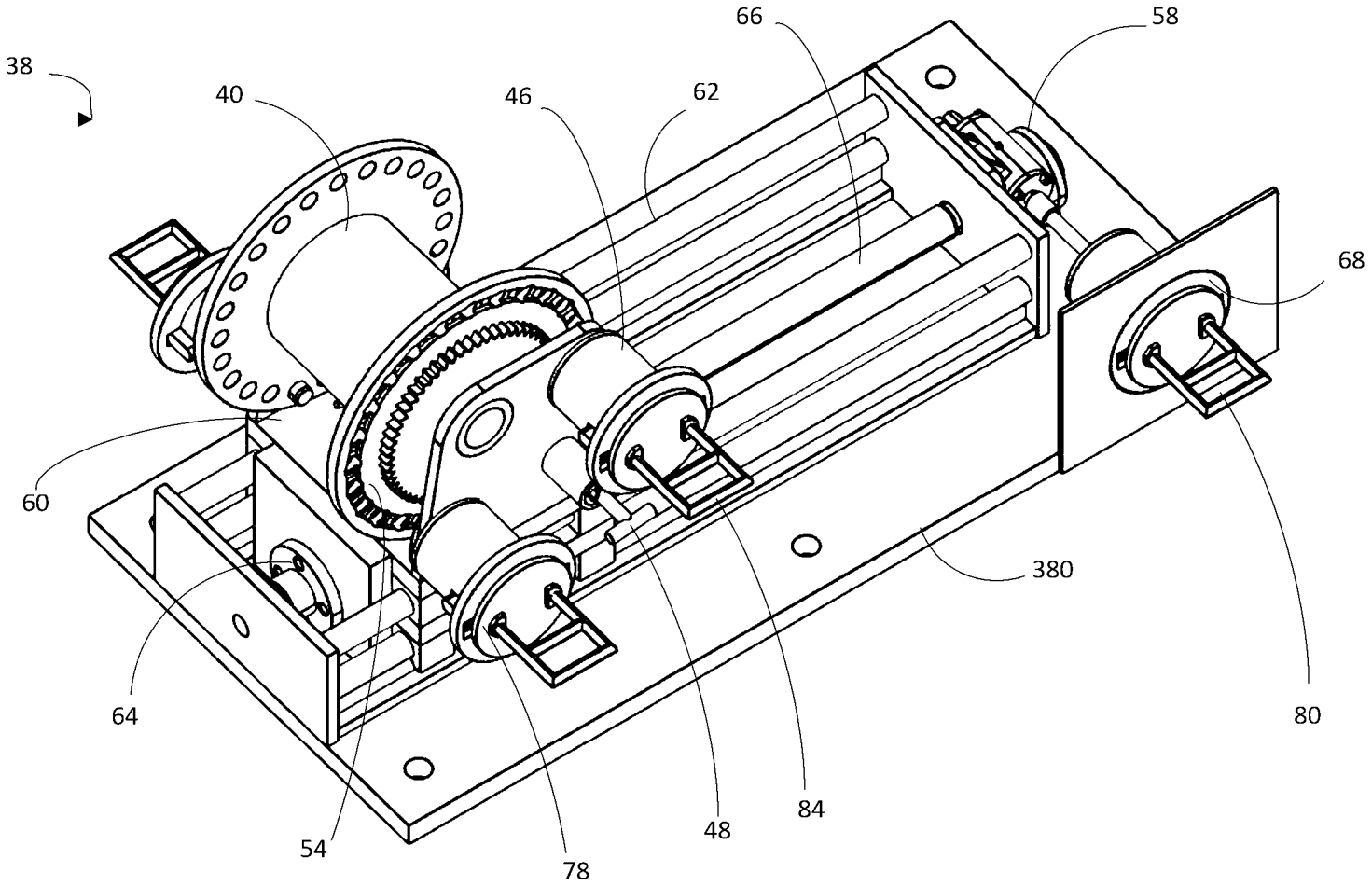
FIG. 9 shows a perspective view of the tensioning apparatus of FIG. 5 showing the first tensioning mechanism in an extended configuration.
Figure 10:
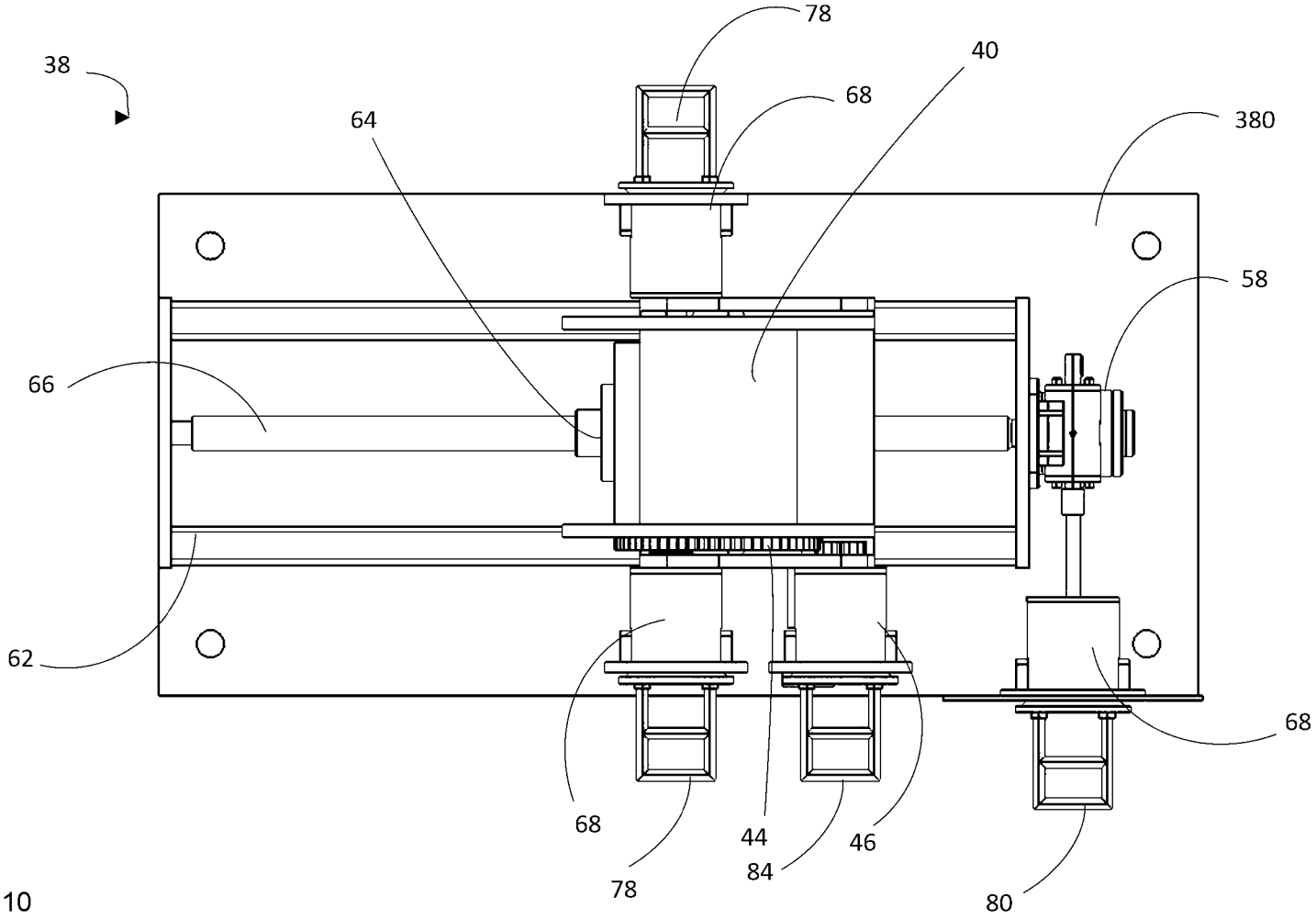
FIG. 10 shows a top view of the tensioning apparatus of FIG. 5.
Figure 11:
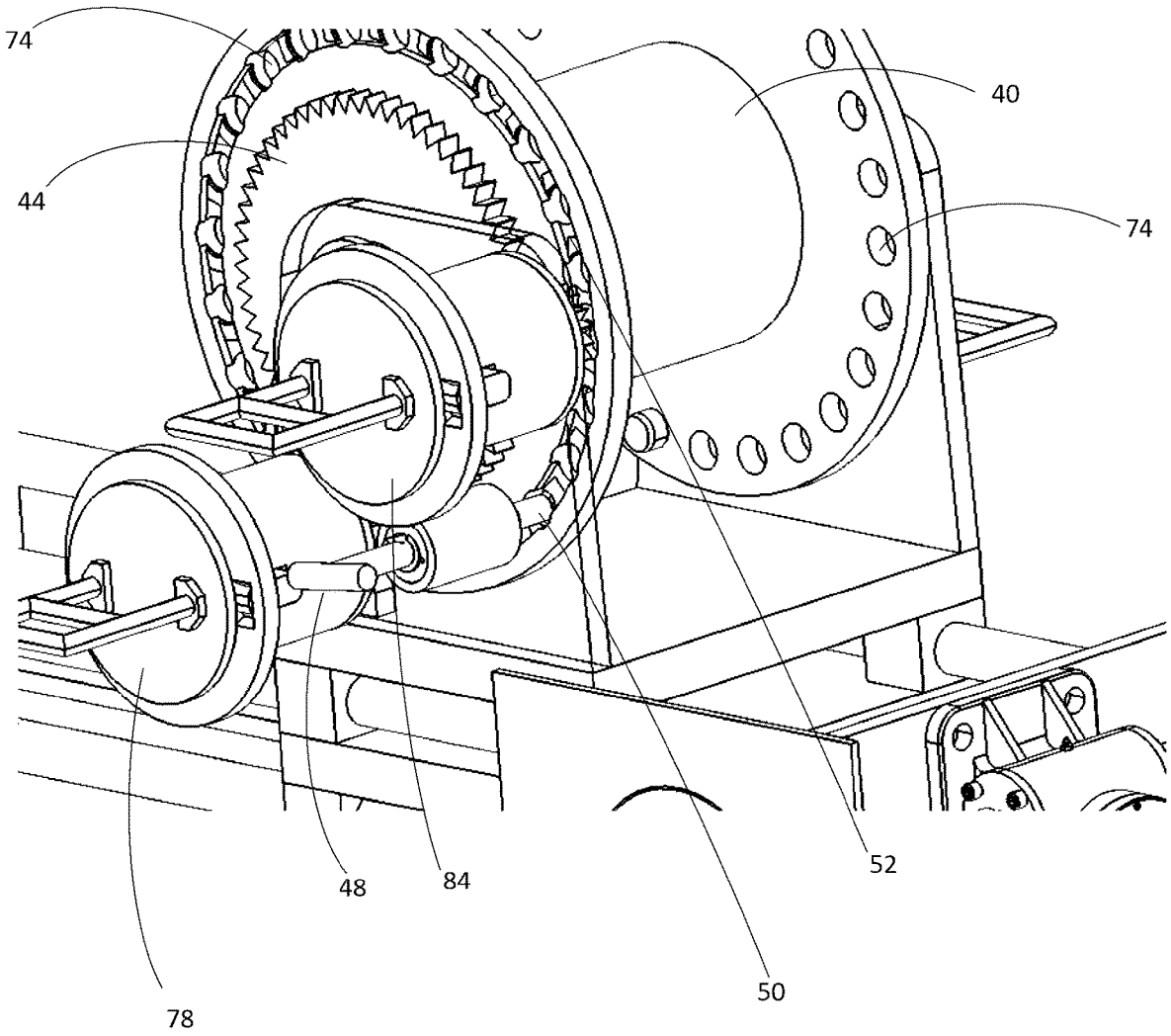
FIG. 11 shows an enlarged view of the first tensioning mechanism of the tensioning apparatus of FIG. 5.

In the illustrated examples, the rotatable drum 40 of the first tensioning mechanism is mounted on a support member 60, which is movably arranged to slide on the four shafts between an extended position and a retracted position and any position therebetween. The final position of the first tensioning mechanism on the four shafts relative to the frame 380 corresponds to the applied second tension acting on tethering member. As shown in FIG. 9, the extended position on the four shafts relative to the frame 380 corresponds to a minimum second tension, preferably zero second tension, applicable to the tethering member. As shown in FIG. 8, the retracted position on the four shafts relative to the frame corresponds to a maximum second tension applicable to the tethering member. It should be understood that the number of load-bearing shafts 62 is illustrative and any suitable number may be used. The load nut 64 is fixed to the support member 60 to prevent the load nut 64 from rotating with the screw 66. In this way, rotation of the rotatable screw 66 causes the load nut 64 to move in a linear direction along the screw 66, thereby moving the support member 60, and rotatable drum 40 along the screw 66 and shafts 62, in a retracting direction or returning direction relative to the frame 380. As such, the first tensioning mechanism is linearly displaced relative the frame in a retracting direction or returning direction depending on the direction of rotation of the rotatable screw. In the second tension mode, as the first tensioning mechanism, and thereby the tethering member, is linearly displaced in a retracting direction towards the retracted position on the four shafts relative to the frame, a second tension increases in the tethering member. Likewise, in the second slack mode, as the first tensioning mechanism, and thereby the tethering member is linearly displaced in a returning direction towards the extended position on the four shaft, second tension in the tethering member reduces (second slack mode). If the first tensioning mechanism is linearly displaced to the extended position then the second tension in the tethering member is reduced to a zero second tension. Displacing the first tensioning mechanism to the extended position reverses the application of the second tension during the second tension mode.

The second tensioning mechanism may also comprise a second actuator to actuate the second tensioning mechanism to apply the second tension. The second actuator is operable to be driven by an associated second driving tool. The second driving tool may be carrier and controlled by an ROV.

In the examples of the tensioning apparatus shown in FIGS. 4A-21, the second actuator comprises a second driving rod comprising an interconnection 42' to engage with the associated second driving tool. The second driving rod is operably coupled to the screw jack 58. The second actuator further comprises an ROV bucket 68 to guide the associated second driving tool into engagement with the second driving rod interconnection 42'. As shown in the examples, the interconnection 42' of the second driving rod protrudes within a central portion of the ROV bucket 68. Rotation of the second driving rod by the second driving tool causes the screw-jack 58 to drive the linear displacement load nut 64, and therefore the first tensioning mechanism, in a retracting direction along the shafts 62 relative to the frame 380, and towards the retracted position. When desired, the driving tool may rotate the second driving rod in the opposite direction to drive the linear displacement of the load nut 64, and therefore the first tensioning mechanism, in a returning direction along the screw 66, and towards the extended position. The second actuator may be driven by the second driving tool to move the first tensioning mechanism in a retracted direction to a predetermined position on the shafts 62 relative to the frame 380 to apply a predetermined second tension to the tethering member. The second actuator may be driven by the second driving tool to move the first tensioning mechanism in a returning direction to a predetermined position on the shafts 62 relative to the frame 380 to reduce the tension in the tethering member from the applied predetermined second tension to a reduced predetermined second tension.

The second tensioning mechanism may comprise a second lock to lock the second tensioning mechanism to at least substantially maintain the second tension applied to the tethering member. The second lock may at least substantially prohibit release of the second tensioning mechanism to maintain the second tension. The second lock may be a self-locking locking mechanism. In the examples depicted in FIGS. 4A-21, the second primary lock may comprise a self-locking mechanism of the screw jack. For example, and as explained above, the screw thread helix angle of the screw jack may be configured to provide a self-locking effect. This means that when the driving torque on the screw jack is removed, the screw jack will remain substantially motionless and the rotatable screw 66 will not rotate backwards, irrespective of how much load it is supporting. Hence, the first tensioning mechanism will remain in a substantially stationary position and the second tension continues to be substantially applied.

The tensioning apparatus may comprise one or more fail-safe lock to help to at least substantially maintain the tension applied to the tethering member by the tensioning mechanisms. The first tensioning mechanism may comprise a first fail-safe lock. The second tensioning mechanism may comprise a second fail-safe lock.

In the examples depicted in FIGS. 5-21, the first fail-safe lock comprises an actuating pin lock 70. The actuating pin lock 70 is configured to be driven by an associated first fail-safe driving tool. The first fail-safe driving tool may be carried and controlled by an ROV.

As shown, the actuating pin lock comprises a locking pin 72 operable to be inserted in a corresponding pin aperture 74 of the rotatable drum 40. The locking pin comprises an interconnection 72' to engage with the associated first fail-safe driving tool. The actuating pin lock comprises an ROV bucket 76 to guide the first fail-safe driving tool into engagement with the interconnection 72'. The interconnection 72' protrudes within a centre portion of the ROV bucket 76. Driving of the locking pin by the first fail-safe driving tool in the direction of the drum causes the locking pin to be inserted in a corresponding pin aperture 74 formed in the drum and the drum to be locked in position. Driving of the locking pin by the first fail-safe driving tool in an opposite direction away from drum causes the locking pin to be released from the corresponding pin aperture.

In the examples depicted, a plurality of pin apertures 74 are arranged circumferentially around each flange 56 of the drum and a pair of actuating pin locks 70 are arranged relative to each corresponding flange of the drum 40.

In the examples shown in FIGS. 5-21, the first fail-safe lock may further comprise an insertable locking plug 78 comprising locking teeth, locking dogs or other suitable locking connections to interlock the locking pin 72 and ROV bucket 76 and thereby restrict movement of the locking pin 72. The locking plug 78 may be employed by an ROV.

In the examples provides in FIGS. 4A-21, the second fail-safe lock comprises a brake to prohibit actuation of the second actuator. In this example the second fail-safe lock comprises an insertable locking plug 80 comprising locking teeth, locking dogs or other suitable locking connections to interlock the interconnection 42' of the second driving rod with the ROV bucket 68, and thereby restrict movement of the second driving rod. The locking plug 80 may be employed by an ROV.

The tensioning apparatus may comprise a tensioning monitoring system to monitor the tension of the tethering member. In an example shown in FIG. 20, the tensioning monitoring system may comprise a tension load cell 82 arranged between the screw-jack 58 and a plate 390 of the frame. As tension is applied to the tethering member the tension load cell is compressed and the change in tension is identified. The tensioning monitoring system may comprise communication means to communicate the measured tension to a remote operator and/or location to enable tension monitoring, quantification of external loads on the BOP and/or rapid identification in the event of a potential tethering member failure.

The tensioning apparatus may comprise a clutch to release tension in the tethering member. The clutch may be configured to release tension in the tethering member if the tension exceeds a predetermined tension value. The clutch may comprise a clutch tool engagable with the first actuator of the first tensioning mechanism and/or the second actuator of the second tensioning mechanism. In the examples shown in FIGS. 4A-21, the clutch is a clutch tool 84 insertable into the ROV bucket 46 of the first actuator of the first tensioning mechanism to engage with the interconnection 42 of the first driving rod. The clutch tool 84 comprises a first portion 86 comprising locking teeth 88, locking dogs or other locking connections to engage with the first actuator ROV bucket 46. The clutch tool further comprises a second portion 90 comprising a recess 92 to engage with the interconnection 42 of the first driving rod of the first actuator. The first and second portions 86, 90, are rotatably coupled such that the second portion can rotate independently of the first portion when the tension of the tethering member exceeds a predetermined tension. Accordingly, when the tension of the tethering member exceeds the predetermined torque, the second portion of the clutch tool may slip to rotate relative to the first portion and thereby the first driving rod may rotate to drive the drum to rotate and release tension in the tethering member.

Figure 12A:
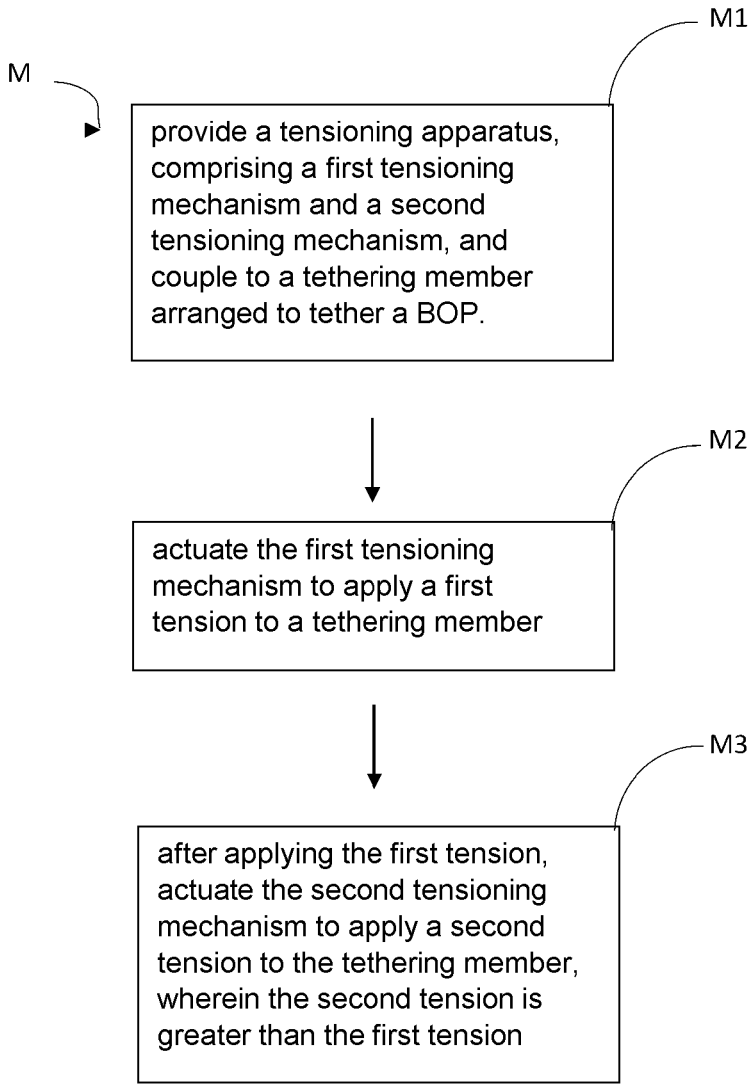
FIG. 12A shows an example of a method of tensioning a tethering member tethering a subsea blowout preventer (BOP) according to the present invention.

A method M according to the present invention of tensioning a tethering member tethering a subsea blowout preventer (BOP) under tension is shown in FIG. 12A. In a first step M1, a tensioning apparatus 38 according to the present invention is arranged in a subsea location and coupled to a tethering member arranged to tether a BOP. The tensioning apparatus comprises a first tensioning mechanism and a second tensioning mechanism. In a second step M2, the tensioning apparatus 38 is operated by actuating the first tensioning mechanism to apply a first tension to the tethering member. For example, where the first tensioning mechanism comprises a rotatable drum 40, actuating the first tensioning mechanism comprises rotating the drum to reel-in the tethering member and thereby apply the first tension to the tethering member. The first tension may be sufficient to reduce, preferably remove, slack in the tethering member.

In a third step M3, and subsequent to the first step and application of a first tension to the tethering member, the second tensioning mechanism is actuated to apply a second tension to the tethering member. The second tension is greater than the first tension. The combined tension applied to the tethering member may be sufficient to restrict, preferably prevent, movement of the tethering member caused when the BOP is subject to undesirable loads that induce bending movement and fatigue. For example, when the second tensioning mechanism comprises a screw jack 58 with a linear drive and the first tensioning mechanism is slidably arranged on a frame 380, actuating the second tensioning mechanism comprises driving the linear drive to linearly displace the first tensioning mechanism, and thereby the tethering member, in a retracting direction relative to the frame 380 to apply the second tension to the tethering member. That is, the first tensioning mechanism is displaced in a retracting direction that increases tension in the tethering member.

Figure 12B:
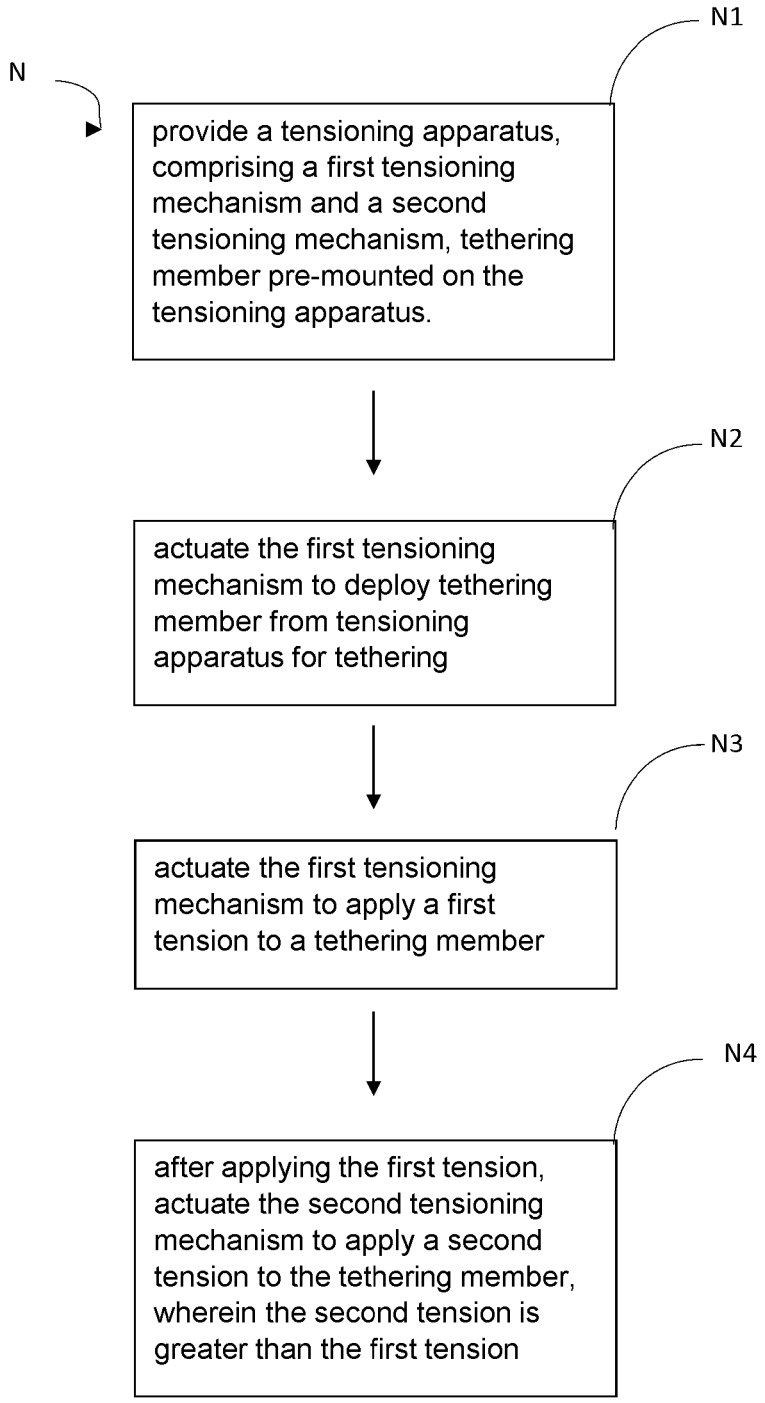
FIG. 12B shows an alternative example of a method of tensioning a tethering member tethering a subsea blowout prevent (BOP according to the present invention.

An alternative method N according to the present invention is shown in FIG. 12B. In a first step N1, a tensioning apparatus according to the present invention is arranged in a subsea location. In this example, the tensioning apparatus comprises a first tensioning mechanism, a second mechanism and a tethering member pre-mounted on the first tensioning mechanism. In step N2, the tensioning mechanism is operated by actuating the first tensioning mechanism to deploy the pre-mounted tethering member for tethering of the tethering member between the BOP and mount. For example, where the first tensioning mechanism comprises the rotatable drum 40 and the tethering member is pre-wound on the drum, actuating the first tensioning mechanism comprises freely rotating the drum to reel-out the tethering member to allow for tethering of the tethering member between the BOP and mount. In a third step N3, the tensioning apparatus is operated by actuating the first tensioning mechanism to apply a first tension to the tethering member. In an example, actuating the first tensioning mechanism comprises rotating the drum to reel-in the tethering member and thereby apply the first tension to the tethering member. The first tension may be sufficient to reduce, preferably remove, slack in the tethering member.

In a fourth step N4, and subsequent to the application of a first tension to the tethering member in step N3, the second tensioning mechanism is actuated to apply a second tension to the tethering member. The second tension is greater than the first tension. The combined tension applied to the tethering member may be sufficient to restrict, preferably prevent, movement of the tethering member caused when the BOP is subject to undesirable loads that induce bending movement and fatigue. For example, when the second tensioning mechanism comprises a screw jack 58 with a linear drive and the first tensioning mechanism is slidably arranged on a frame 380, actuating the second tensioning mechanism comprises driving the linear drive to linearly displace the first tensioning mechanism, and thereby the tethering member, in a retracting direction relative to the frame 380 to apply the second tension to the tethering member. Displacing the first tensioning mechanism in the retracting direction increases tension in the tethering member.

Figure 12C:
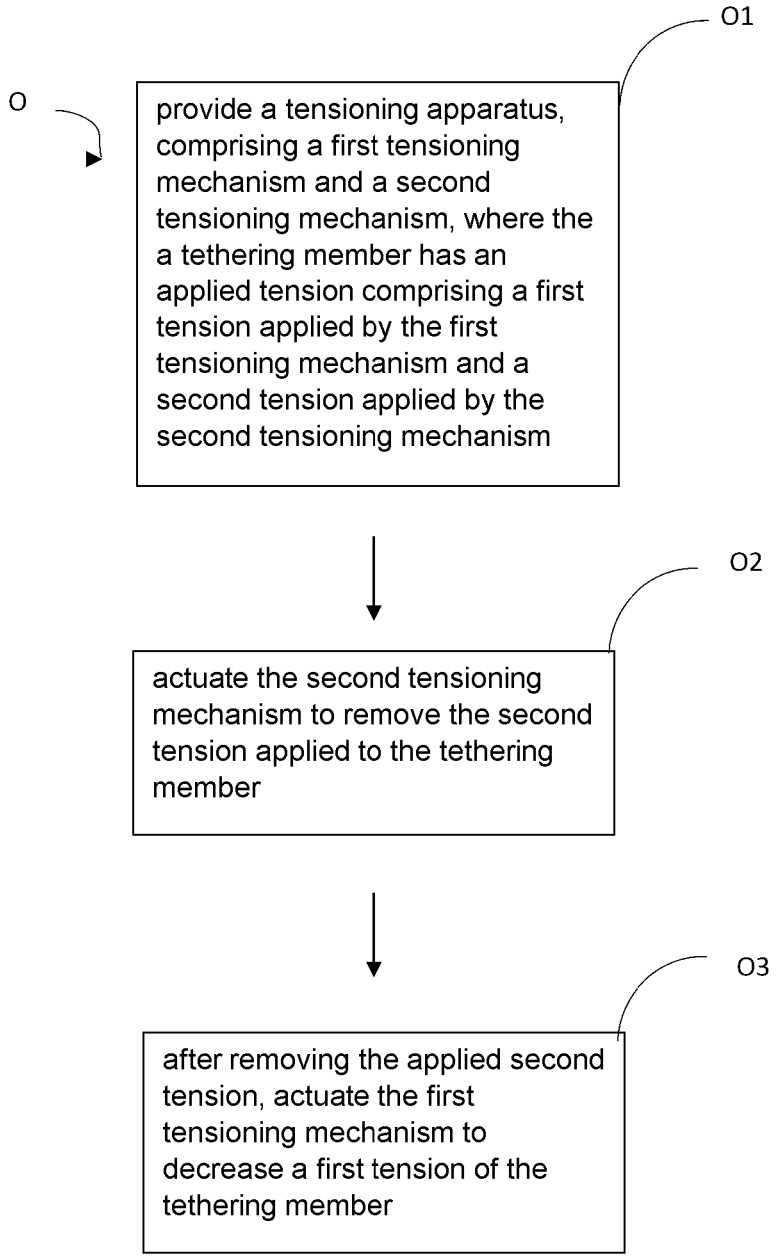
FIG. 12C shows an example of a method of reducing tension in a tethering member following the application of tension according to the present invention.
Figure 13:
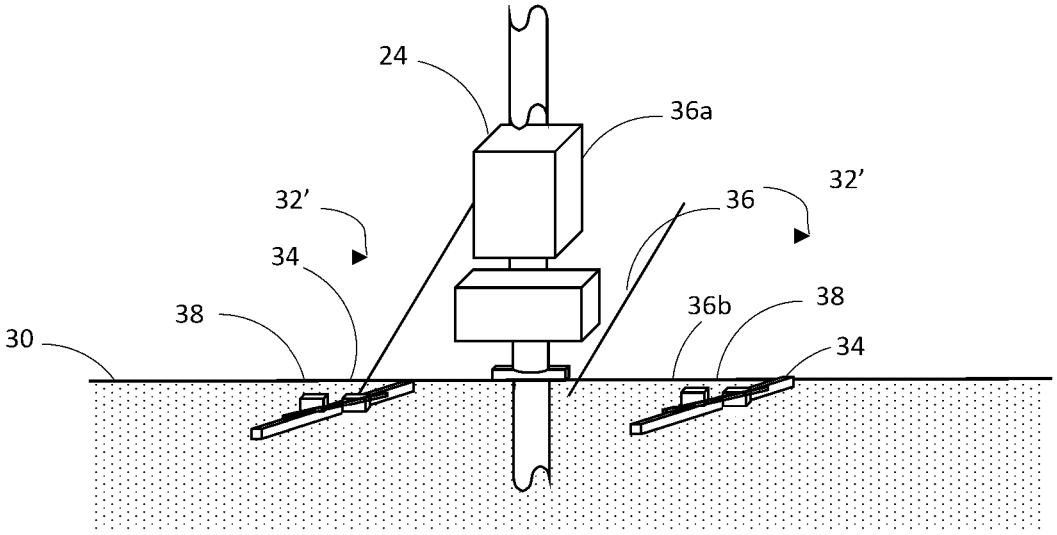
FIG. 13 shows a schematic view of a first example tensioning system according to the present invention.
Figure 14:
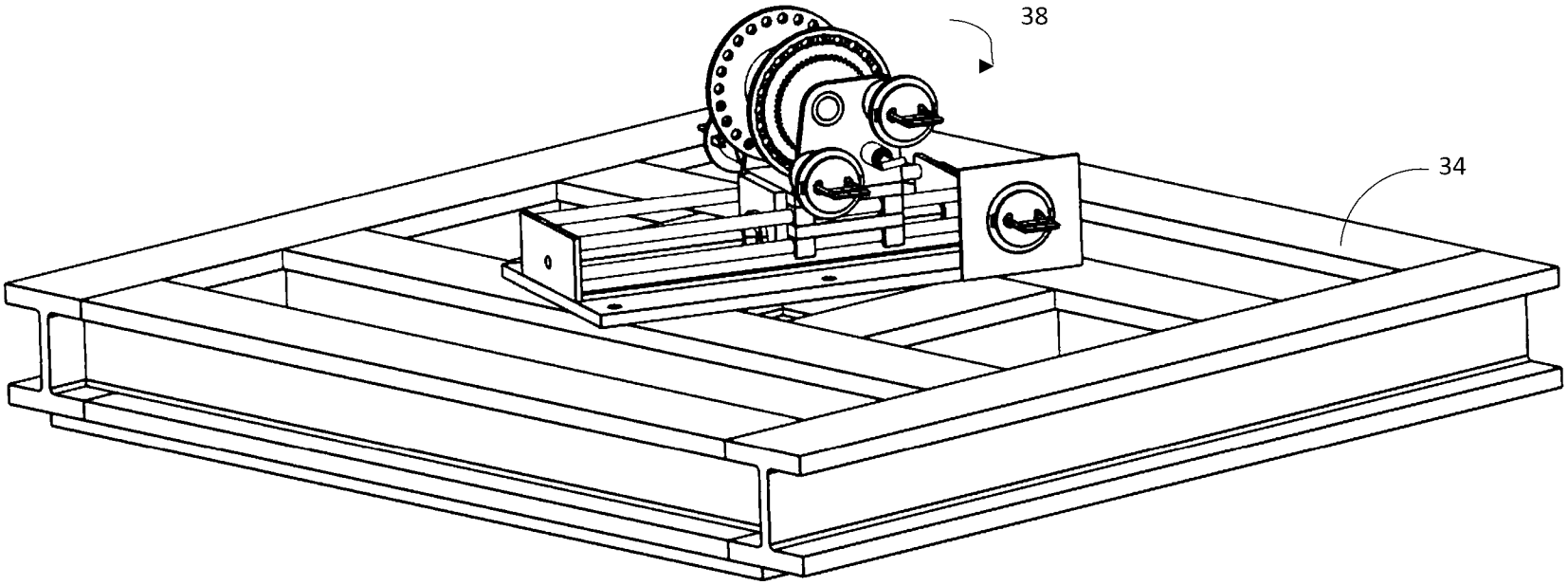
FIG. 14 shows a perspective view of the tensioning apparatus of FIG. 13 on a mount.
Figure 15:
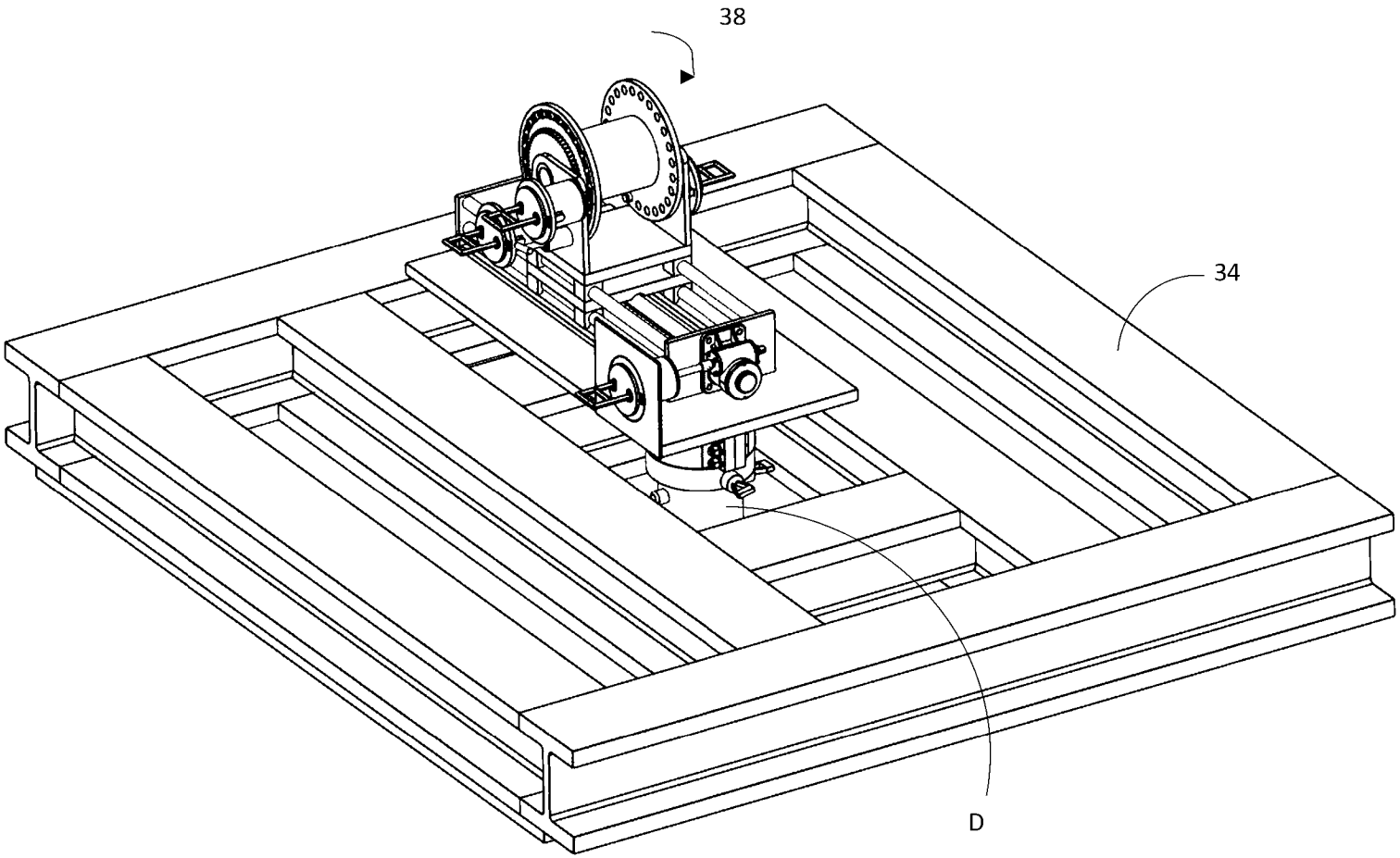
FIG. 15 shows an alternative perspective view of the tensioning apparatus on a mount shown in FIG. 14.
Figure 16:
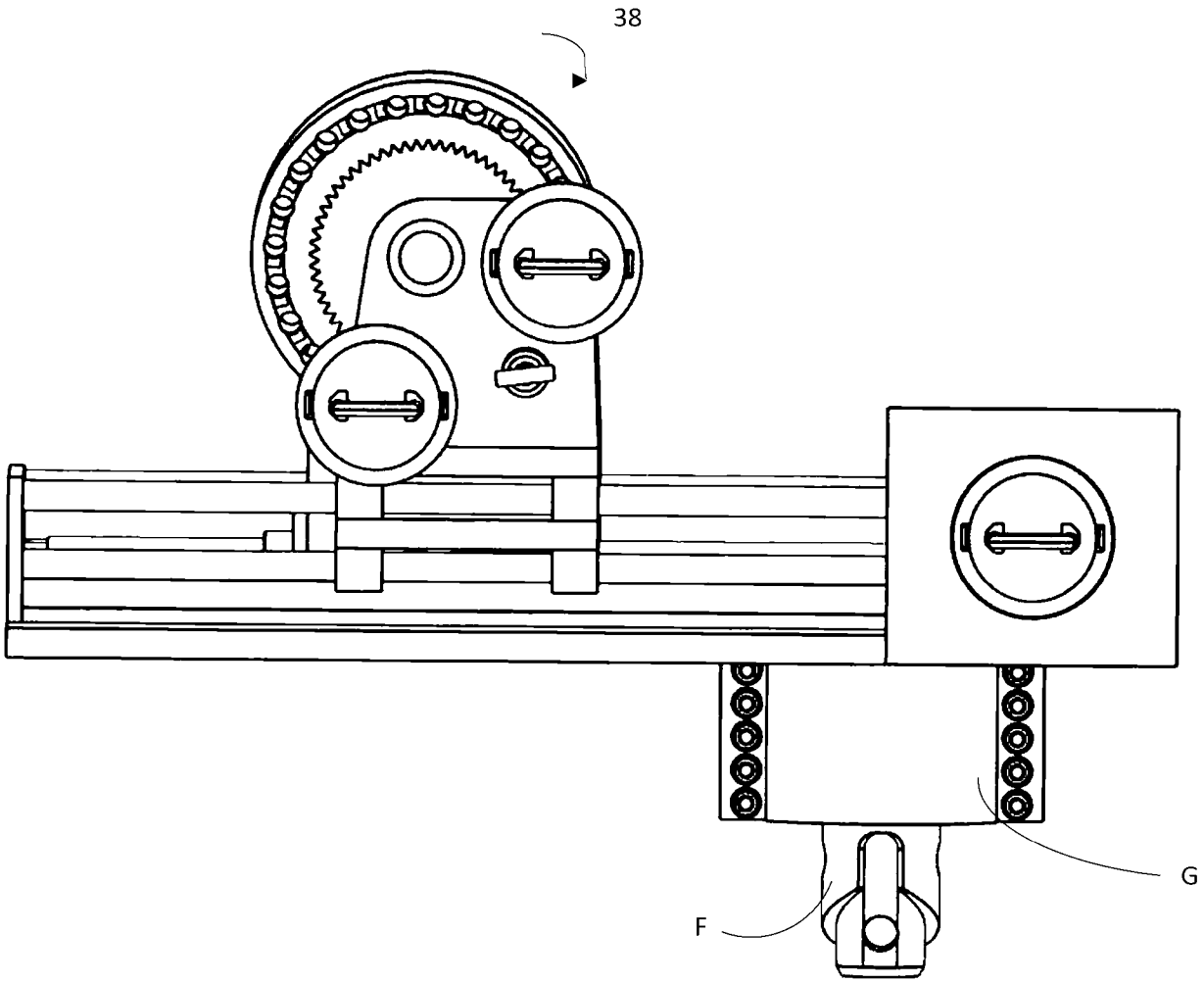
FIG. 16 shows a side on view of the tensioning apparatus of FIG. 14 without the mount.
Figure 17:
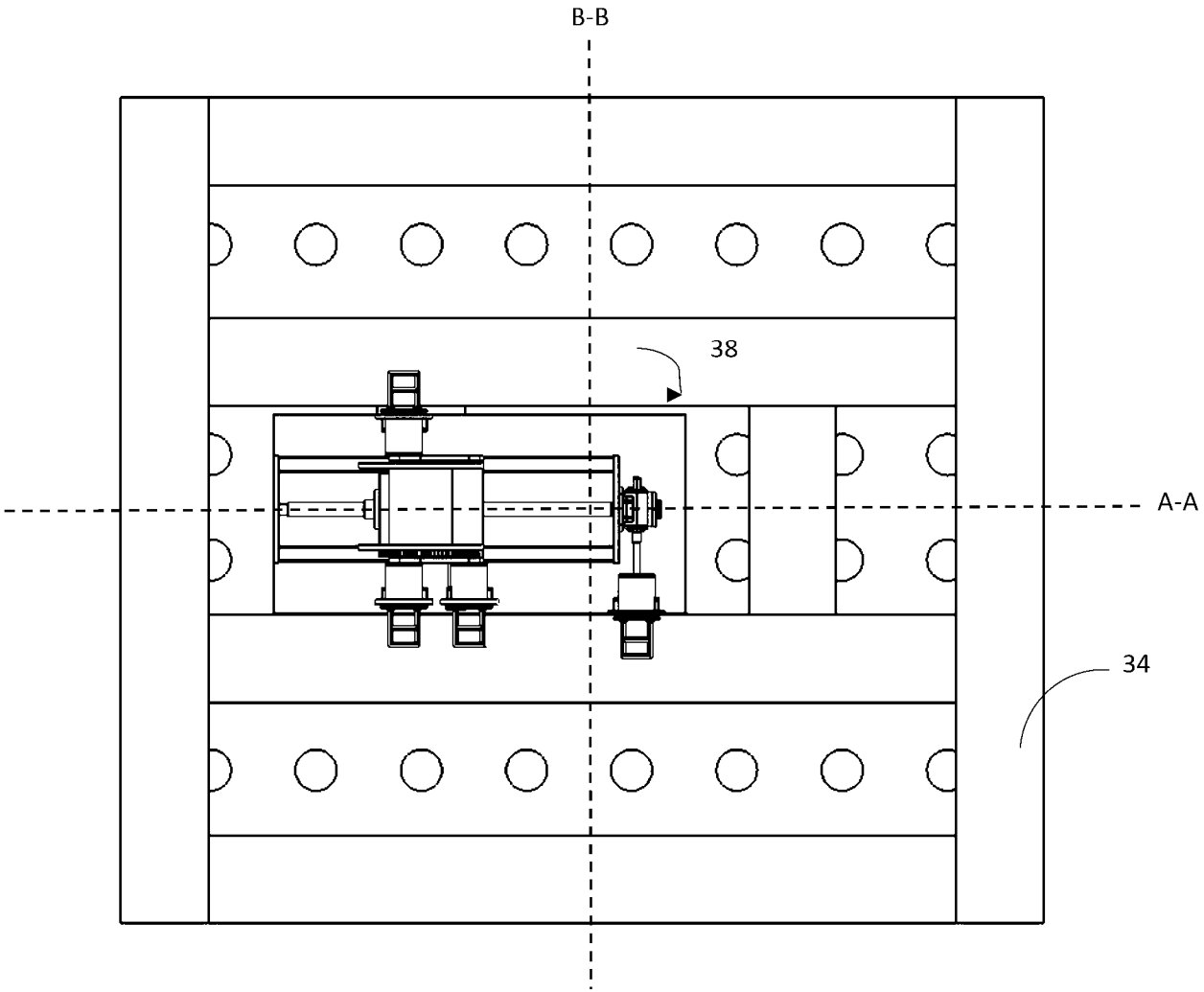
FIG. 17 shows a top view of the tensioning apparatus on a mount shown in FIG. 14.
Figure 18:
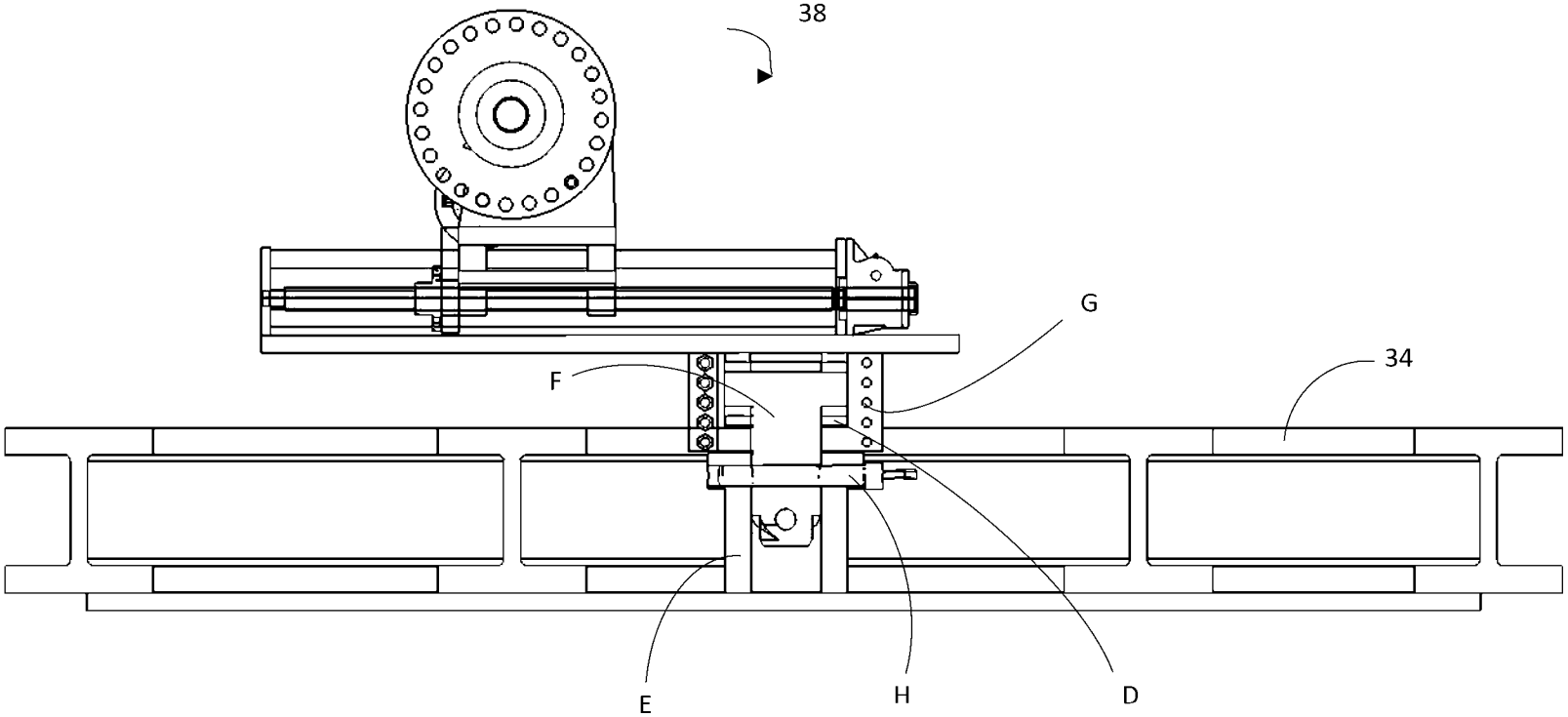
FIG. 18 shows a cross-sectional view along A-A of the tensioning apparatus on a mount shown in FIG. 14.
Figure 19:
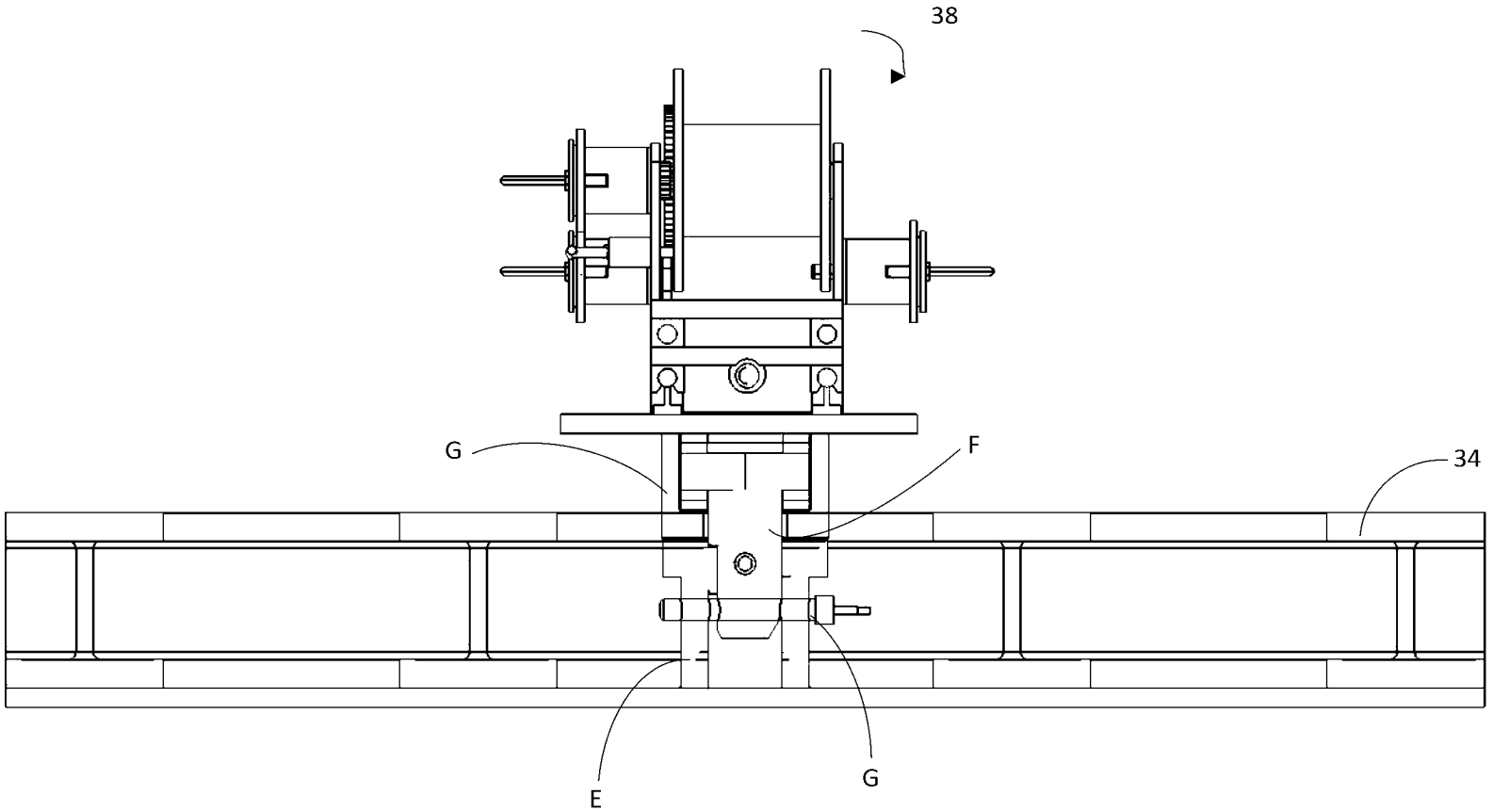
FIG. 19 shows a cross-sectional view along B-B of the tensioning apparatus on a mount shown in FIG. 14.
Figure 20:
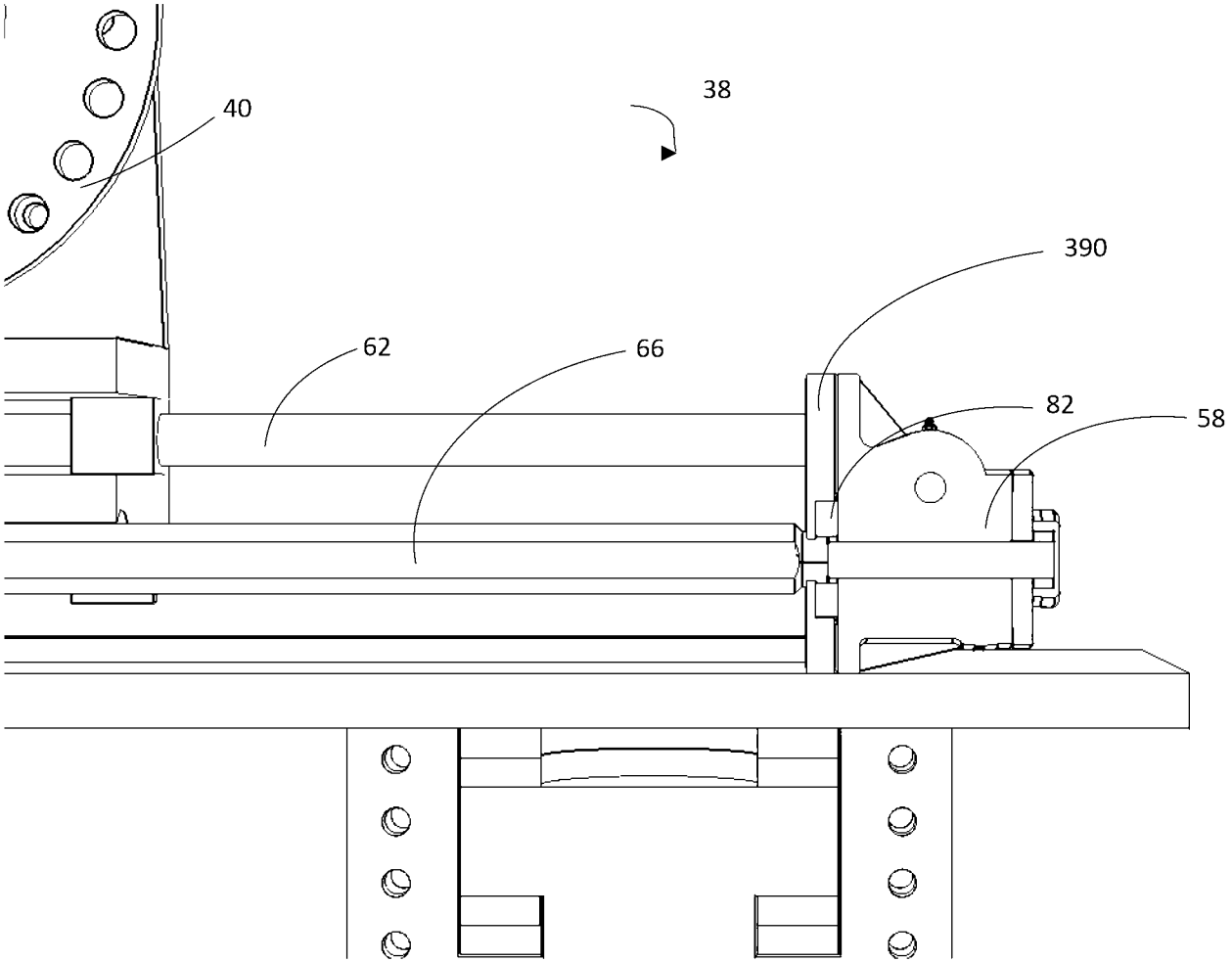
FIG. 20 shows an enlarged view of the second tensioning mechanism of the tensioning apparatus shown in FIG. 16.

The further method O of the present invention is shown in FIG. 12C. As shown in the first step O1 this method follows the application of first tension and second tension in the tethering member of a tensioning apparatus, for example as shown in method M of FIG. 12A or method N of FIG. 12B. In a second step O2, the tensioning apparatus is operated by actuating the second tensioning mechanism to remove the second tension applied to the tethering member. For example, where the second mechanism comprises a screw jack 58 with a linear drive and the first mechanism is slidably arranged on a frame 380, actuating the second tensioning mechanism comprises driving the linear drive to linearly displace the first tensioning mechanism, and thereby the tethering member, in a returning direction relative to the frame 380 to an extended position where the second tension acting on the tethering member is a zero second tension.

In a third step O3, the tensioning apparatus is operated by actuating the first tensioning mechanism to reduce the first tension in the tethering member. In an example where the first tensioning mechanism comprises a rotatable drum 40, actuating the first tensioning mechanism comprises rotating the drum to reel-out the tethering member and thereby decrease the applied first tension in the tethering member. Removing the applied second tension and decreasing the first tension in the tethering member allows for slack in the tethering member.

The tensioning mechanism is configured to apply a tension to the tethering member so as to reinforce and/or stabilize the BOP 24, horizontal tree 16, wellhead 18 and primary conductor 20 by restricting movement of BOP 24. As a result, the tensioning apparatus 38 according to the present invention improves the strength and fatigue resistance, and reduces bending moments, of the BOP 24, the horizontal tree 16 (when present), wellhead 18 and primary conductor 20.

FIGS. 13 to 21 depict examples of multiple tensioning systems 32', 32" arranged to tether a subsea blowout preventer (BOP) 24 of a well system as shown in FIG. 2 for example. Any suitable number of tensioning systems may be utilised to provide a desired tethering effect of the BOP.

In the examples depicted in FIGS. 13 to 21 each tensioning system 32', 32" for tethering a subsea blowout preventer (BOP) under tension comprises a mount 34 arranged on the sea bed 30 in spaced relationship to the BOP 24, a tethering member 36 to tether the BOP 24 to the mount, a tensioning apparatus 38 to apply a tension to the respective tethering member.

The mount may comprise a gravity base or similar.

In the context of the present invention, a sea bed may be understood to mean any subsea surface that allows for the arrangement of the mount in spaced relationship to the BOP to achieve a tethering effect as the tethering member extends from the BOP to the mount.

In general, the tethering member 36 may comprise or consist of any elongate flexible member suitable for subsea use and capable of withstanding the anticipated tensile loads without deforming or elongating. Non-limiting examples of suitable tethering members include chain(s), wire rope, and Dyneema® rope available from DSM Dyneema LLC of Stanley, North Carolina USA. In the particular embodiments shown, the tethering member comprises Dyneema® rope, which is suitable for subsea use and is sufficiently strong to withstand the anticipated tensions.

As seen in the tensioning system 32' depicted in FIGS. 13 to 20, the tensioning apparatus 38 may be coupled to the mount 34.

The tensioning apparatus may be removably coupled to the mount.

The tensioning apparatus 38 may be rotatably coupled to the mount 34 to allow for rotation about a vertical axis that is substantially perpendicular to the sea bed 30. The tensioning system may comprise a coupling to rotatably couple the tensioning apparatus to the mount. In the example shown in FIGS. 13 to 20, the coupling D may comprise a recess E to receive a rotatable key F. As shown in this example, the rotatable key extends from an underside of the tensioning apparatus 38 and fits into the recess formed in the mount. The rotatable key comprises a bearing housing G to control the rotation of the key, and thereby control the rotation of the tensioning apparatus relative to the mount. The rotatable key may be secured in the recess using a locking pin H.

In the tensioning system 32' shown in FIGS. 13 to 20, the tethering member 36 extends from the BOP to the mount via the tensioning apparatus. A first end 36*a* of the tethering member 36 is attached to the BOP 24 and a second end 36*b* of the tethering member 36 is attached to the mount via the tensioning apparatus 38. In the example, the tethering member is coupled to the rotatable drum of the first tensioning mechanism so that the tethering member can be wound-in and wound-out as the rotatable drum rotates. The tethering member is pre-wound on the rotatable drum so that the tethering member can be wound-out to deploy the tethering member for tethering, whereby the first end 36*a* of the tethering member is attached to the BOP 24.

Figure 21:
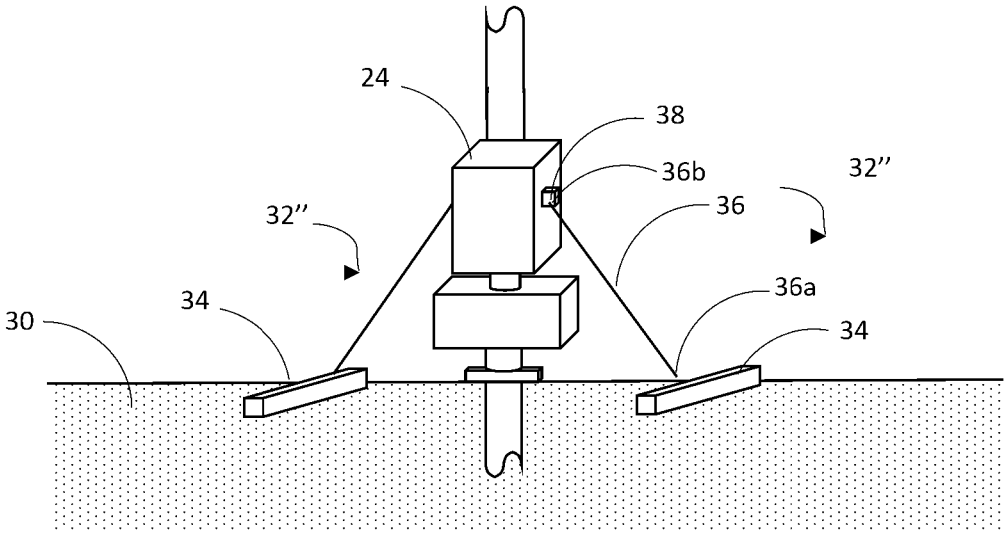
FIG. 21 shows a schematic view of an second example of a tensioning system according to the present invention.
Figure 22:
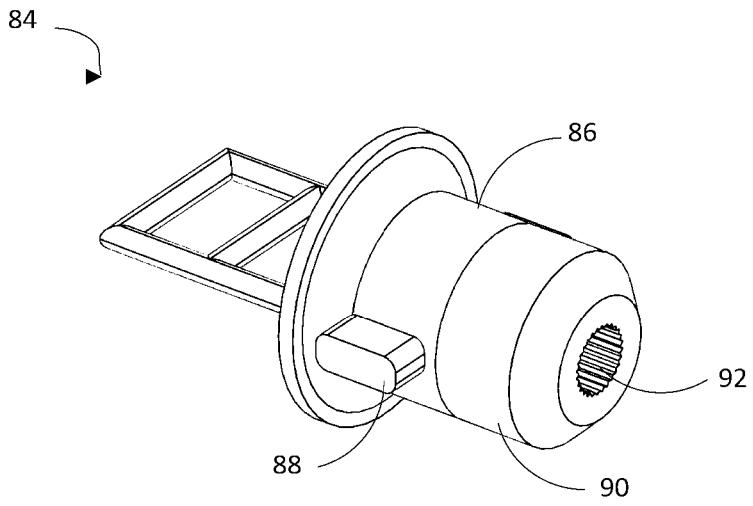
FIG. 22 shows an example of a clutch for the tensioning apparatus of FIG. 4A or 5 according to the present invention.

An alternative arrangement of a tensioning system 32" is shown in FIG. 21 in which the tensioning apparatus 38 may be coupled to the BOP 24, whereby the tethering member 36 extends from the BOP via the tensioning apparatus to the mount. The first end 36*a* of the tethering member 36 is coupled to the mount 34 with the second end 36*b* of the tethering member 36 coupled to the BOP via the tensioning apparatus 38. In the example, the tethering member is coupled to the rotatable drum of the first tensioning mechanism. The tethering member is pre-wound on the rotatable drum so that the tethering member can be wound-out to deploy the tethering member for tethering, whereby the first end 36*a* of the tethering member is attached to the mount 34.

It should be appreciated that tethering systems 32', 32" may be deployed and installed on an existing mounts or BOP 24. Moreover, mounts 34 and tensioning apparatus 38 mounted thereto can be independently retrieved and reused at different locations as required.

The tensioning apparatus may apply a tension to the tethering member during one or more mode of operation of the well system. For example, the tensioning apparatus may apply tension to the tethering member during the installation of the well system, during drilling, intervention, during deconstruction and/or abandonment of the well system.

It will be appreciated by persons skilled in the art that the above embodiment has been described by way of example only and not in any limitative sense, and that various alterations and modifications are possible without departing from the scope of the invention as defined by the appended claims.

The invention claimed is:

1. A subsea tensioning apparatus for tensioning a tethering member, wherein the tethering member is configured to tether a subsea blowout preventer (BOP) to a subsea mount arranged on a sea bed, the tensioning apparatus comprising:

a first tensioning mechanism configured to apply a first tension to the tethering member; and a second tensioning mechanism configured to subsequently apply a second tension to the tethering member, wherein the second tension is greater than the first tension, wherein the first tensioning mechanism is moveable by the second tensioning mechanism and the second tensioning mechanism is configured to move the first tensioning mechanism to apply the second tension to the tethering member.

2. The tensioning apparatus according to claim 1, wherein the first tensioning mechanism is a mechanically driven tensioning mechanism, and wherein the second tensioning mechanism is a mechanically driven tensioning mechanism.

3. The tensioning apparatus according to claim 1, wherein the first tensioning mechanism comprises a first actuating means, and the first actuating means is operable by an associated first driving tool; and wherein the second tensioning mechanism comprises a second actuating means, and the second actuating means is operable by an associated second driving tool.

4. The tensioning apparatus according to claim 1, wherein the first tensioning mechanism comprises a rotatable drum configured to reel-in the tethering member and thereby apply the first tension to the tethering member.

5. The tensioning apparatus according to claim 4, wherein the rotatable drum is configured to reel-out the tethering member and thereby reduce the first tension applied to the tethering member.

6. The tensioning apparatus according to claim 1, wherein the first tensioning mechanism comprises a first lock to lock the first tensioning mechanism to at least substantially retain the first tension applied to the tethering member.

7. The tensioning apparatus according to claim 6 wherein the first lock is configured to prevent back rotation of the rotatable drum.

8. The tensioning apparatus according to claim 1, wherein the first tensioning mechanism is configured to reduce the first tension applied to the tethering member.

9. The tensioning apparatus according to claim 1, further comprising a frame wherein the first tensioning mechanism is moveably arranged on the frame and the second tensioning mechanism is configured to move the first tensioning mechanism relative to the frame in a retracting direction, and thereby apply the second tension to the tethering member.

10. The tensioning apparatus according to claim 9, wherein the second tensioning mechanism comprises a screw jack having a linear drive, wherein the linear drive is configured to linearly displace the first tensioning mechanism relative to the frame in the retracting direction and thereby apply the second tension to the tethering member.

11. The tensioning apparatus according to claim 10, wherein the linear drive is configured to linearly displace the first tensioning mechanism relative to the frame in a returning direction and thereby reduce the second tension applied to the tethering member.

12. The tensioning apparatus according to claim 1, wherein the second tensioning mechanism comprises a second lock to lock the second tethering mechanism to at least substantially maintain the second tension applied to the tethering member.

13. The tensioning apparatus according to claim 1, wherein the second tensioning mechanism is configured to reduce the second tension applied to the tethering member.

14. The tensioning apparatus according to claim 1, further comprising one or more fail-safe lock to at least substantially maintain the tension applied to the tethering member.

15. The tensioning apparatus according to claim 1, further comprising a tension monitoring system configured to monitor tension in the tethering member.

16. The tensioning apparatus according to claim 1, further comprising a clutch mechanism configured to automatically release tension in the tethering member under excess loading.

17. The tensioning apparatus according to claim 1, wherein the tensioning apparatus is configured to deploy a tethering member pre-mounted on the tethering apparatus for tethering.

18. The tensioning apparatus according to claim 17, wherein the pre-mounted tethering member is pre-wound on the rotatable drum, and the rotatable drum is configured to reel-out the tethering member to deploy the pre-mounted tethering member for tethering, and optionally wherein the rotatable drum is configured to free-wheel to reel-out the tethering member.

19. A subsea tensioning system for tethering a subsea blowout preventer (BOP) under tension, the system comprising:

a subsea mount arranged on a sea bed in spaced relationship to the BOP;

a tethering member configured to tether the BOP to the subsea mount;

a tensioning apparatus configured to apply a tension to the tethering member, wherein the tensioning apparatus comprises:

a first tensioning mechanism configured to apply a first tension to the tethering member; and a second tensioning mechanism configured to subsequently apply a second tension to the tethering member, wherein the second tension is greater than the first tension, wherein the first tensioning mechanism is moveable by the second tensioning mechanism and the second tensioning mechanism is configured to move the first tensioning mechanism to apply the second tension to the tethering member.

20. The system according to claim 19, wherein the tensioning apparatus is secured to the mount or to the BOP.

21. The system according to claim 20, wherein the tensioning apparatus is rotatably secured to the mount or the BOP.

22. The system according to claim 20, wherein the tensioning apparatus is removably secured to the mount or the BOP.

23. A method for tensioning a tethering member, wherein the tethering member is arranged to tether a subsea blowout preventer (BOP) to a subsea mount, the method comprising:

actuating a first tensioning mechanism to apply a first tension to the tethering member; and after applying the first tension, actuating a second tensioning mechanism to apply a second tension to the tethering member, wherein the second tension is greater than the first tension.

24. The method according to claim 23, wherein the first tensioning mechanism comprises a rotatable drum and wherein actuating the first tensioning mechanism comprises rotating the drum to reel-in the tethering member and thereby apply the first tension to the tethering member, and optionally wherein rotating the drum comprises freely rotating the drum.

25. The method according to claim 23, wherein the first tensioning mechanism is movably arranged on a frame and the second tensioning mechanism comprises a linear drive; and wherein actuating the second tensioning mechanism comprises driving the linear drive to linearly displace the first tensioning mechanism in a retracting direction on the frame and thereby apply the second tension to the tethering member.

* * * * *